US009027924B2

(12) United States Patent
Yokoyama et al.

(10) Patent No.: US 9,027,924 B2
(45) Date of Patent: May 12, 2015

(54) INFORMATION RECORDING DEVICE

(75) Inventors: Naoki Yokoyama, Yamanashi (JP); Akira Takei, Yamanashi (JP); Tatsuya Asakawa, Yamanashi (JP); Hiromitsu Tamura, Yamanashi (JP); Yuichi Aihara, Yamanashi (JP)

(73) Assignees: Toppan Printing Co., Ltd., Tokyo (JP); Nisca Corporation, Minamikoma-gun, Yamanashi (JP)

( * ) Notice: Subject to any disclaimer, the term of this patent is extended or adjusted under 35 U.S.C. 154(b) by 0 days.

(21) Appl. No.: 13/990,644

(22) PCT Filed: Nov. 30, 2011

(86) PCT No.: PCT/JP2011/077655

§ 371 (c)(1),
(2), (4) Date: May 30, 2013

(87) PCT Pub. No.: WO2012/074001

PCT Pub. Date: Jun. 7, 2012

(65) Prior Publication Data

US 2013/0249164 A1 Sep. 26, 2013

(30) Foreign Application Priority Data

Nov. 30, 2010 (JP) ..... 2010-267548
Dec. 7, 2010 (JP) ..... 2010-272183
Mar. 16, 2011 (JP) ..... 2011-057589

(51) Int. Cl.
*B65H 5/06* (2006.01)
*B65H 7/00* (2006.01)
(Continued)

(52) U.S. Cl.
CPC . *B65H 5/062* (2013.01); *B41J 3/50* (2013.01); *B41J 11/006* (2013.01); *B41J 13/12* (2013.01); *G03G 21/1638* (2013.01); *G03G 21/1642* (2013.01); *G03G 15/70* (2013.01)

(58) Field of Classification Search
CPC ..... B65H 5/062
USPC ..... 271/264, 256; 347/218, 222; 399/124
See application file for complete search history.

(56) References Cited

U.S. PATENT DOCUMENTS 6,249,303 B1 * 6/2001 Mochizuki et al. ..... 347/222
6,567,112 B2 * 5/2003 Suzuki ..... 347/217

(Continued)

FOREIGN PATENT DOCUMENTS

JP 07271923 A * 10/1995 ..... G06K 13/063
JP H07-271923 A 10/1995

(Continued)

*Primary Examiner* — Patrick Cicchino
(74) *Attorney, Agent, or Firm* — Manabu Kanesaka

(57) ABSTRACT

Provided is an information recording device in which jam processing operation can be easily performed with simple operation when a recording medium such as a card is jammed in a conveyance passage. A card storing section and a medium conveyance passage for conveying a card to an image forming section are arranged in a housing at upper and lower sides and a passage open-close member for removing a card jammed at the image forming section is arranged therebetween. Then, electronic information recording means is incorporated in the passage open-close member and a medium conveyance path which conveys a card toward the electronic information recording means is arranged on a medium introduction passage for feeding a card from the card storing section to the medium conveyance passage. According to the above, a card jammed at the image forming section or the information recording section can be easily removed to the outside of the device by opening the card storing section.

13 Claims, 18 Drawing Sheets

(51) Int. Cl.

| | |
|---|---|
| ***G03G 21/00*** | (2006.01) |
| ***B41J 3/50*** | (2006.01) |
| ***B41J 11/00*** | (2006.01) |
| ***B41J 13/12*** | (2006.01) |
| ***G03G 21/16*** | (2006.01) |
| ***G03G 15/00*** | (2006.01) |

(56) References Cited

U.S. PATENT DOCUMENTS

| | | | | |
|---|---|---|---|---|
| 6,587,135 | B1 * | 7/2003 | Suzuki et al. | 347/217 |
| 6,722,649 | B2 * | 4/2004 | Yui | 271/184 |
| 6,742,706 | B2 * | 6/2004 | Sakamoto et al. | 235/439 |
| 6,762,780 | B2 * | 7/2004 | Tsuruta et al. | 347/171 |
| 2006/0220859 | A1 * | 10/2006 | Nagai et al. | 340/572.1 |

FOREIGN PATENT DOCUMENTS

| | | | |
|---|---|---|---|
| JP | 2000-187712 | A | 7/2000 |
| JP | 2001-063893 | A | 3/2001 |
| JP | 2001-353892 | A | 12/2001 |
| JP | 2002-099872 | A | 4/2002 |
| JP | 2002-109476 | A | 4/2002 |
| JP | 2005-222206 | A | 8/2005 |
| JP | 2007-237744 | A | 9/2007 |

* cited by examiner

INFORMATION RECORDING DEVICE

RELATED APPLICATIONS

The present application is National Phase of International Application No. PCT/JP2011/077655 filed Nov. 30, 2011, and claims priority from Japanese Applications No. 2010-267548, filed Nov. 30, 2010; No. 2010-272183, filed Dec. 7, 2010; and No. 2011-057589, filed Mar. 16, 2011.

TECHNICAL FIELD

The present invention relates to an information recording device which records electronic information and image information on a recording medium such as a plastic card and a thick-paper card, and relates to improvement of a jam processing mechanism which eliminates a card jammed in the device.

BACKGROUND ART

In general, such an information recording device has been widely known as a device to record information on a card or the like which is to be used as a card for every kind of identification, a credit card for commercial payment, or the like. For example, such a device is used for a terminal device of a card issuing system as a device to record electronic information such as magnetic information and IC information on a card and to form image date such as a face photograph, a name, and an organization on front and back faces of a card.

For example, in Patent Literature 1 (Japanese Patent Application Laid-Open No. 2007-237744), a card cassette, an ink ribbon cassette, and a transfer film cassette are attached into a housing to be replaceable in a detachably attachable manner. Here, attaching and detaching operation of the cassettes requires operability for an operator to be easily performed.

In addition, even in a case that a malfunction of card conveyance occurs at an electronic information recording section or an image forming section, processing thereof is required to be easily performed.

For example, Patent Literature 1 discloses a device having a layout structure that an open-close door is arranged at a front portion of the device and the card cassette, the ribbon cassette, and the film cassette are to be attached and detached through the open-close door. Here, not disclosed in the literature, it is general that a card jammed in a passage is removed while the open-close door at the device front side is opened even when a card conveyance malfunction occurs.

Meanwhile, in a general image forming device, there has been widely known a jam open-close mechanism which provides accessibility to a medium conveying section from the outside of the device while opening an open-close door which is arranged at a device housing when a medium conveyance malfunction occurs at the inside of the device.

Further, in this case, it has been known that posture of a unit structuring a conveying mechanism to open a conveyance passage is deflected from operational posture to retreat posture.

CITED LITERATURE

Patent Literature

Patent Literature 1: Japanese Patent Application Laid-Open No. 2007-237744

Patent Literature 2: Japanese Patent Application Laid-Open No. 7-271923

Patent Literature 3: Japanese Patent Application Laid-Open No. 2000-187712

Patent Literature 4: Japanese Patent Application Laid-Open No. 2001-063893

SUMMARY OF THE INVENTION

Problems to be Solved by the Invention

As described above, it has been well known that an open-close door of a device housing is arranged for processing when jamming occurs at a card conveyance passage in the device. In the device of Patent Literature 1, the card cassette, the ribbon cassette, and the transfer film cassette are detached through an open-close cover (e.g., a front cover) of the device housing, and concurrently, a jammed card is removed from the conveyance passage while opening the open-close cover.

Accordingly, a card jammed in the passage is required to be removed at limited open-close space in the device. Therefore, operation to remove a jammed card is complicated and there is a case that a component (e.g., a sensor) placed on the passage is damaged.

Then, the inventors have noticed that operational space for removing a jammed card can be enlarged with a card cassette detached by arranging a storing section of the card cassette and a medium conveyance passage of an image forming section at the upper and lower sides in a device housing and configuring a partition wall between the storing section and the medium conveyance passage to be openable and closable as a passage open-close member for removing a jammed card.

An object of the present invention is to provide an information recording device in which jam processing operation can be easily performed with simple operation when a recording medium such as a card is jammed in a conveyance passage.

Further, an object of the present invention is to provide an information recording device in which jam processing operation is easily performed while a device to record electronic information and image information on a recording medium such as a card is structured in a small and compact manner.

Means for Solving the Problem

To address the above issues, in the present invention, a card storing section and a medium conveyance passage for conveying a card to an image forming section are arranged in a housing at upper and lower sides and a passage open-close member for removing a card jammed at the image forming section is arranged therebetween.

Then, electronic information recording means is incorporated in the passage open-close member and a medium conveyance path which conveys a card toward the electronic information recording means is arranged on a medium introduction passage for feeding a card from the medium storing section to the medium conveyance passage.

According to the above, a card jammed at the image forming section or the information recording section can be easily removed to the outside of the device by opening the card storing section.

Specifically, the structure of the above includes a housing, a medium storing section which stores a recording medium, an information recording section which records electronic information on a recording medium, an image forming section which forms image information on a recording medium, a medium introduction passage which introduces a recording medium from the medium storing section toward the information recording section, a medium conveyance passage which conveys the recording medium conveyed from the medium introduction passage to the image forming section, and a passage open-close member which is arranged at the medium conveyance passage for removing a recording medium jammed at the image forming section.

Here, the medium storing section, the passage open-close member, and the image forming section are arranged in the housing in this order, and the information recording section includes electronic information recording means which is incorporated in the passage open-close member, and a medium conveyance path which conveys a recording medium from the medium conveyance passage toward the electronic information recording means.

The electronic information recording means is structured with non-contact type recording means which records information on a recording medium in a non-contact state. For example, the non-contact type recording means is configured to transmit electronic information as a radio wave signal to an IC chip embedded in a recording medium to be received by the IC chip.

A shielding plate which shields a radio wave signal of the non-contact type recording means is arranged between the medium conveyance path and the medium conveyance passage. Here, the shielding plate is formed of a shielding material (radio wave absorber) which shields a recording medium on the medium conveyance passage from a radio wave signal transmitted from the non-contact type recording means. A material which absorbs and shields radio waves in a specific band is selected as the shielding material.

The medium storing section includes a cassette mount area to which a cassette storing a recording medium is attachable. The passage open-close member is formed by arranging a partition wall (bottom face wall) of the cassette mount area to be openable and closable. The passage open-close member is configured to form the bottom face wall of the cassette mount area in a closed state and to provide accessibility to the medium conveyance passage from the cassette mount area in an opened state.

The medium conveyance passage is provided with a turning unit which switches a conveying direction of a recording medium at least between two directions being first and second directions. Here, the turning unit is configured to switch between the first direction in which a recording medium is to be conveyed to the information recording section and the second direction in which a recording medium is conveyed to the medium conveyance passage.

The turning unit includes a rotary frame which is supported axially and swingably by a device frame, at least one roller pair which is arranged at the rotary frame to hold a recording medium, unit drive means which swings the rotary frame, and roller drive means which rotates the roller pair forwardly and reversely. Here, a recording medium is introduced to and conveyed from the medium conveyance path with rotation of the roller pair in forward and reverse directions.

A de-curl mechanism is arranged on the medium conveyance passage at the downstream side from the image forming section. The de-curl mechanism includes a pressing portion which corrects a curl of an image-formed recording medium, and a unit frame which holds the pressing portion. Here, the passage open-close member is configured to provide accessibility to the de-curl mechanism from the outside of the housing in an opened state.

The unit frame of the de-curl mechanism is supported axially and rotatably by a device frame so that the pressing portion is movable from the inside of the medium conveyance passage to the outside thereof when the passage open-close member is in an opened state.

Advantageous Effects of the Invention

In the present invention, the medium storing section C and the medium conveyance passage are arranged at upper and lower sides and the passage open-close member for removing a jammed card is arranged therebetween. Then, the electronic information recording means is incorporated in the passage open-close member and the medium conveyance path which conveys a card is arranged at the recording means. According to the above, following effects are obtained.

Owing to that the medium storing section is opened, for example, by detaching a card cassette and the passage open-close member is opened, it is possible to provide accessibility to the medium conveyance passage and the medium conveyance path which conveys a card to the non-contact type recording means from cards storing space. Accordingly, it is possible to easily remove a card jammed at the image forming section or a card jammed at the information recording section.

Further, owing to adopting a structure of attaching and detaching a card cassette as the medium storing section, the medium storing section can be easily opened.

Further, in a case that the de-curl mechanism for curl correction is arranged at the downstream side of the image forming section, a card jammed at the de-curl mechanism can be easily removed similarly to the image forming section.

As described above, according to the present invention, the inside of the device is accessible from the card storing space without arranging a special open-close door at the device housing for jam processing. Therefore, a frame structure of the housing can be simplified as adopting a flexible structure or the like.

EMBODIMENTS OF THE INVENTION

Figure 1:
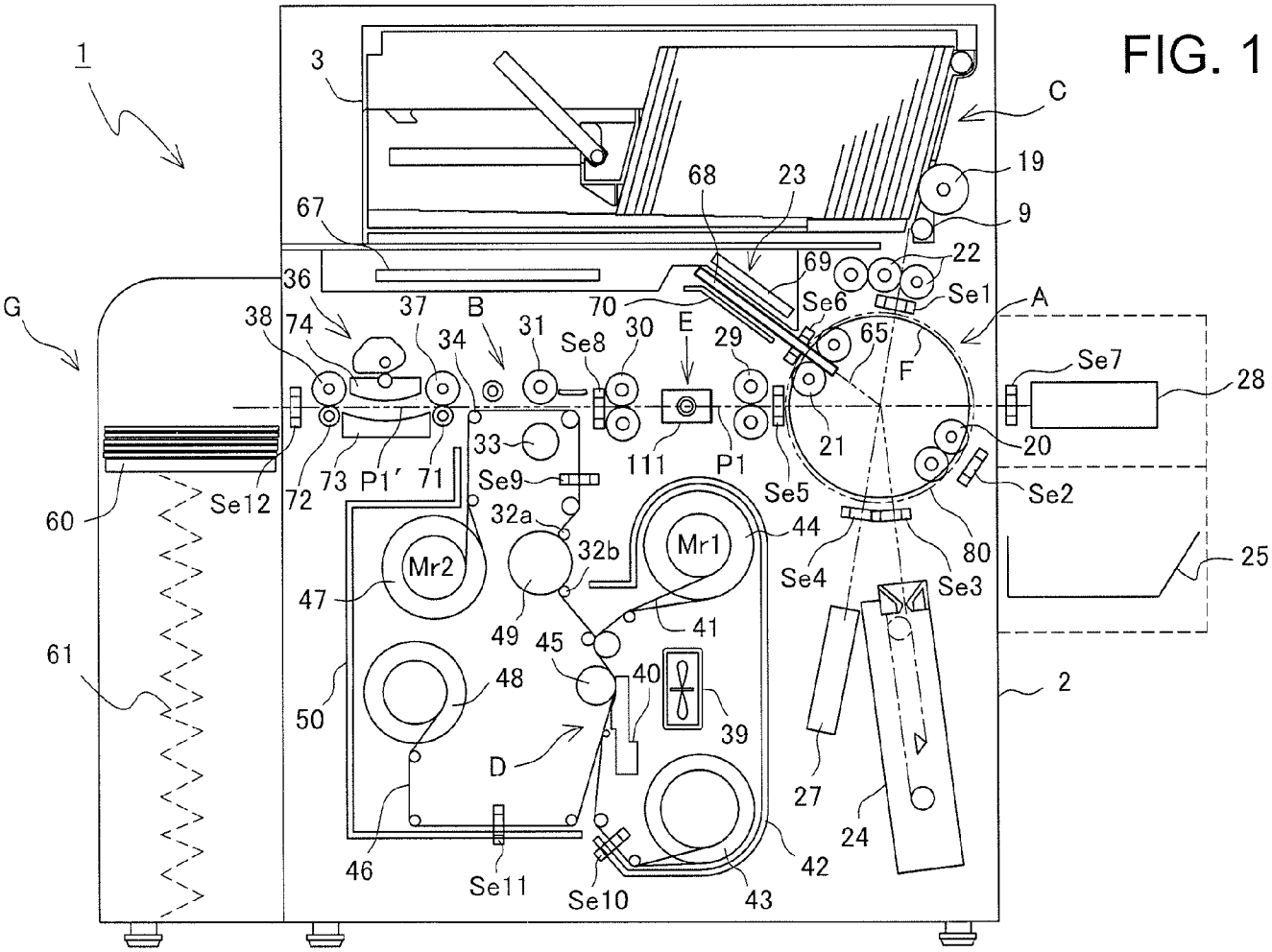
FIG. 1 is an explanatory view illustrating an embodiment of an information recording device according to the present invention.

In the following, the present invention will be described in detail based on preferable embodiments illustrated in the drawings.

FIG. 1 is an explanatory view of a whole structure of an information recording device 1 according to the present invention. The device in FIG. 1 performs "information recording" to electronically record information such as magnetic information and IC information on a card (a recording medium, hereinafter, being the same) such as an ID card for every kind of identification and a credit card for commercial dealings and "image forming (printing)" of characters, pictures, marks and the like on a card surface with thermal transfer. Accordingly, a device housing (outer housing) 2 is provided with an information recording section A, an image transferring section B, and a medium storing section C. Further, the device housing 2 is provided with an image forming section D which forms an image on a transfer film 46 travelable at the image transferring section B.

The information recording section A is structured with a magnetic recording portion 24, a non-contact type IC recording portion 23, and a contact-type IC recording portion 27. The information recording section A is structured with a variety of recording portions, for example, a bar code recorder and the like, in accordance with device specifications.

The device housing 2 is formed of metal, synthetic resin, or the like into an appropriate design shape (box shape in the drawing) by a forming process. The information recording device 1 has a monocoque structure to maintain device strength with an outer plate 2*a* illustrated in the drawings (see FIG. 12 and the like) having reinforcing stays internally arranged at appropriate positions thereof.

Figure 11A:
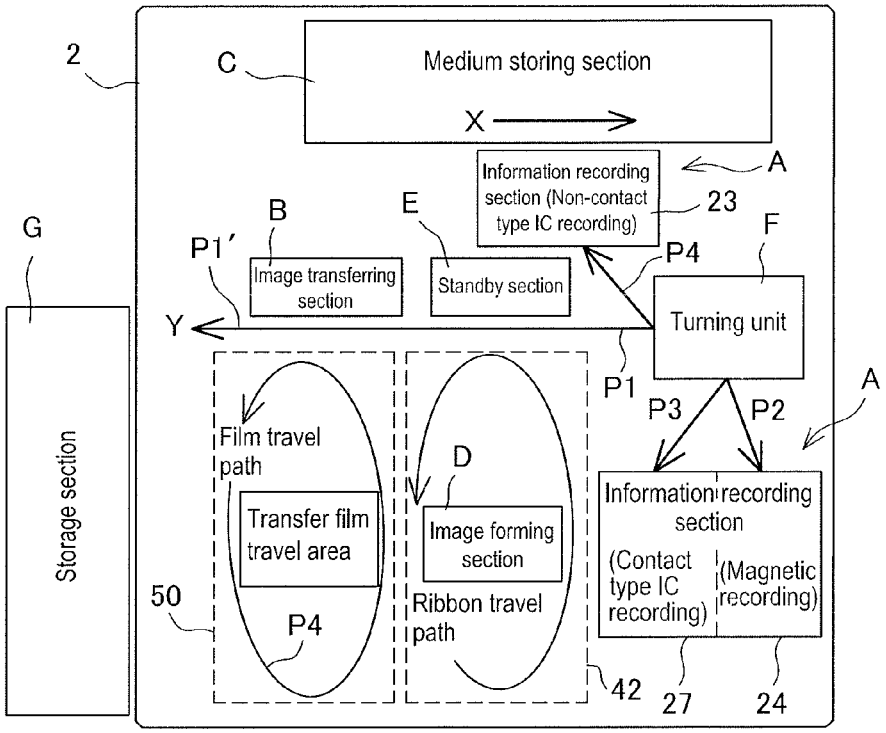
FIG. 11A is a conceptual view illustrating a layout structure of the device in FIG. 1
Figure 11B:
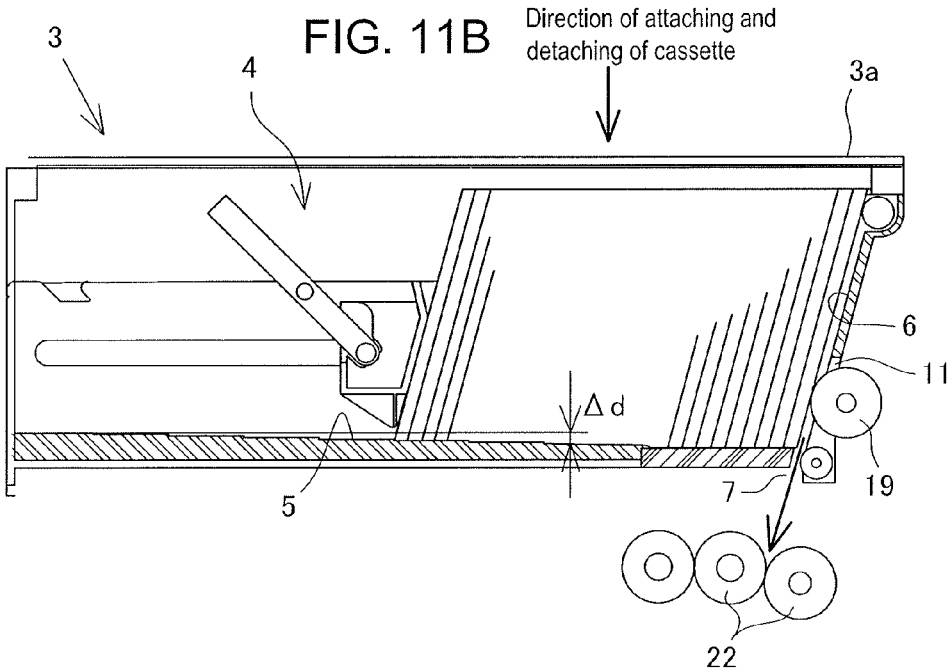
FIG. 11B is a sectional view of the card cassette.

FIGS. 11A and 11B are conceptual views illustrating a layout structure of the device in FIG. 1. An internal structure of the device housing 2 will be described with reference to FIGS. 11A and 11B.

The device housing 2 is provided with the medium storing section C and a turning unit F which changes a direction of a card fed from the medium storing section C. A first medium conveyance passage P1 for conveying a card in a first direction and a second medium conveyance passage P2 for conveying a card in a second direction are arranged at the downstream side of the turning unit F. Further, separately from the second medium conveyance passage P2, a third medium conveyance passage P3 for conveying a card in a third direction and a fourth medium conveyance passage for conveying a card in a fourth direction are arranged in the device of FIG. 1.

The image transferring section B which records (prints) image information on a card is arranged at the first medium conveyance passage P1. The magnetic recording portion 24 which records magnetic information on a card is arranged at the second medium conveyance passage P2. Here, the magnetic information is recorded on a magnetic stripe of a card fed from the turning unit F. The magnetic recording unit 24 in the drawing is structured with a read/write head and is configured to record magnetic information and perform right-wrong determination as reading the recorded information. Further, the contact-type IC recording portion 27 which records IC information on a card is arranged at the third medium conveyance passage P3 and the non-contact type IC recording portion 23 being different from the contact-type IC recording portion 27 is arranged at the fourth medium conveyance passage P4. Here, information recording is performed on an IC which is previously embedded in a recording medium. In the following, each structure mounted on the housing 2 will be described.

[Medium Storing Section]

Figure 2:
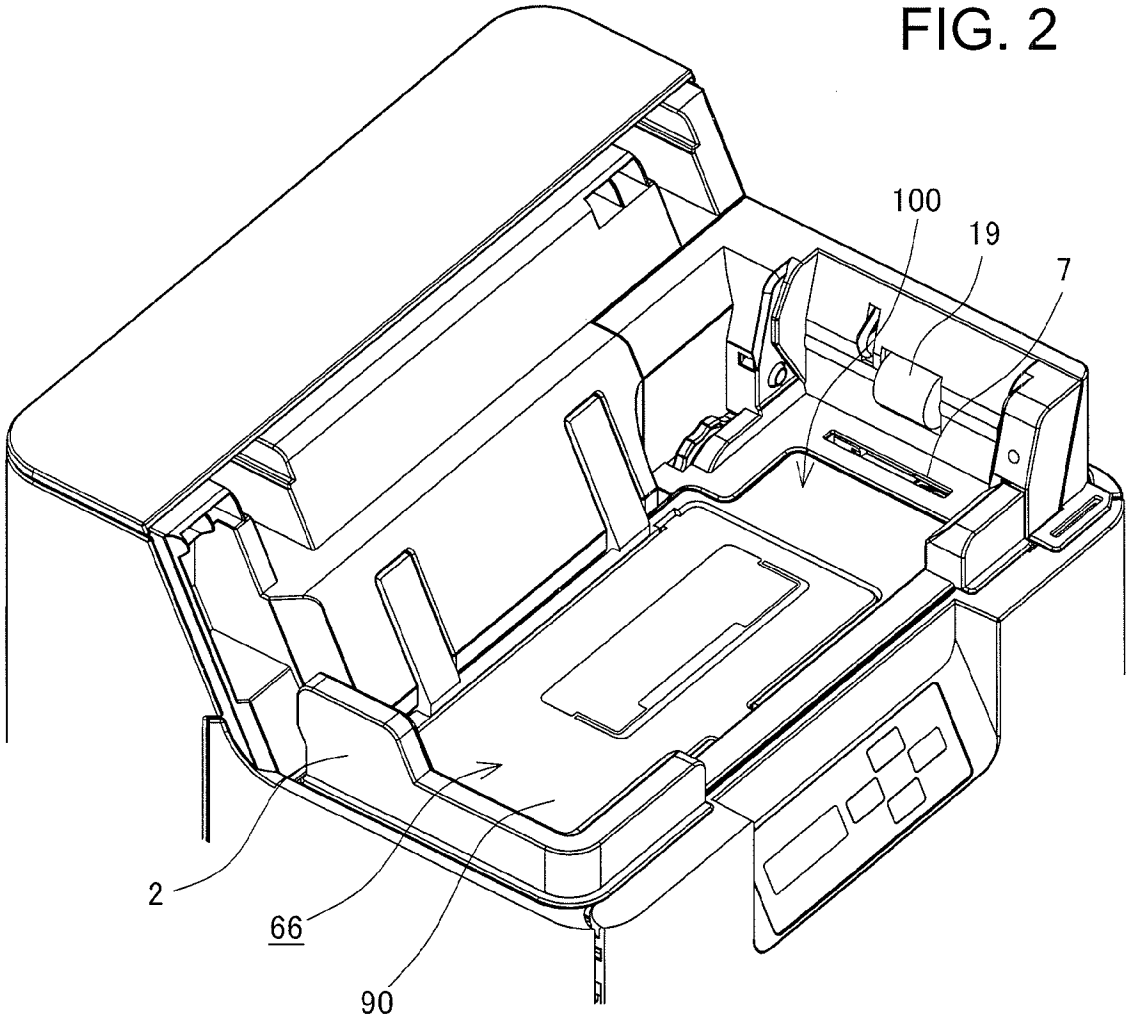
FIG. 2 is a view illustrating a state that a card cassette is removed.

The medium storing section C is arranged at a cassette mount area 100 of the device housing 2. The medium storing section C has a hopper mechanism which stores a plurality of cards. The medium storing section C is structured with a card cassette 3 in which a plurality of cards are aligned and stored at standing posture (see FIG. 11B) in a front-back direction (right-left direction in FIG. 11B). As illustrated in FIG. 11B, the card cassette 3 is structured with a box-shaped cassette housing 3*a* and a card storing portion 4 which is arranged in the housing 3*a*. An opening portion for getting card in and out is arranged at the card storing portion 4 at the upper side in the drawing and an open-close cover (not illustrated) which opens and closes the opening portion is hinge-connected. The card cassette 3 is detachable from the cassette mount area 100 of the device housing 2. FIG. 2 illustrates a state that the card cassette 3 is detached from the cassette mount area 100 of the device housing 2. In the present embodiment, for example, when the card cassette 3 is configured to be detachable upward (in the approximately same direction as a later-mentioned card feeding direction) as being lifted with a handle (not illustrated), card jamming occurred at a card feeding portion can be solved by removing the card cassette 3.

Here, a card feeding direction is leaned in the present embodiment. However, a detaching-attaching direction of the card cassette 3 is not necessarily leaned. The card cassette 3 is simply required to have a structure to be lifted upward against the device housing 2.

A proceeding direction of cards in the card cassette 3 (direction of arrow X in FIG. 11A) and a conveying direction of cards in the first medium conveyance passage P1 (direction of arrow Y in FIG. 11A) are arranged approximately in parallel to each other in opposite directions. That is, the card cassette 3 located above in FIG. 11A and the first medium conveyance passage P1 are arranged in parallel at the upper and lower sides. Accordingly, the medium storing section C, the image transferring section B, and a standby section E are laid out in parallel at the upper and lower sides, so that device aggregation is achieved.

As illustrated in FIG. 11B, the card storing portion 4 is configured to have storing space suitable for card dimensions so that a plurality of cards can be stored as being aligned at standing posture in the front-rear direction from one end (left end in the drawing) to the other end (right end). The space is provided with a card placing face 5 on which cards are placed in standing posture and a card engaging face 6 with which a card at the frontmost row is engaged.

The card placing face 5 and the card engaging face 6 maintain cards at frontward-leaned posture. For this reason, the card placing face 5 is formed as a sloped face or a stepped face having height difference Δd in the proceeding direction (direction of arrow X in FIG. 11A). Further, the card engaging face 6 is formed with a leaned face which engages cards at frontward-leaned posture. Here, the card proceeding direction denotes a direction in which cards are placed in the front-back direction to cause cards to proceed toward the opening portion.

A separating opening 7 is formed at the card storing portion 4 at the front end in the proceeding direction. The separating opening 7 is formed as an opening through which a card at the frontmost row can be discharged to the outside of the housing. Further, as illustrated in FIG. 11B, the separating opening 7 is formed into a slit shape so that a card at the frontmost row engaged with the card engaging face 6 in frontward-leaned posture is discharged outside from a bottom portion of the cassette housing 3. The separating opening 7 is configured to be formed into the slit shape through which only a card at the frontmost row can pass as having a thickness and a width of the slit to be suitable to those of cards. Thus, the separating opening 7 constitutes separating means which separates cards one by one.

As illustrated in FIG. 1, the card storing portion 4 has a picker opening 11 which causes a later-mentioned pickup roller 19 to be engaged with a front face of a card at the frontmost row. The picker opening 11 is formed as an opening which causes the pickup roller 19 to be engaged with a card at the frontmost row for feeding the card at the frontmost through the separating opening 7.

[Turning Unit]

A card fed from the card cassette 3 is fed to the turning unit F by an introducing roller 22. The turning unit F is arranged below the medium storing section C as being adjacent thereto and is structured with a rotary frame 80 which is swingably bearing-supported at one end (right end in FIG. 11A) side of the device housing 2 and one pair or plural pairs of rollers which are supported by the rotary frame 80. At the downstream side of the turning unit F, the first medium conveyance passage P1 is arranged approximately in the horizontal direction and the second and third medium conveyance passages P2, P3 are arranged approximately in the vertical direction. It is preferable that the first and second medium conveyance passages P1, P2 are arranged in directions with different angles in an angle range of 90 to 180 degrees as illustrated in the drawing. Here, the arrangement is set in an appropriate angle range in consideration of passage aggregation.

In the turning unit F illustrated in FIG. 1, two roller pairs 20, 21 arranged at the front and rear sides as being distanced from each other are axially supported by the rotary frame 80 as being rotatable respectively. Then, the rotary frame 80 is swung in a direction of a predetermined angle by a turning motor (pulse motor or the like) and the roller pairs 20, 21 attached to the rotary frame 80 are configured to be rotated in forward and reverse directions by a conveying motor. A driving mechanism for the above (not illustrated) may be configured to perform switching with a clutch between swinging of the rotary frame 80 and rotating of the roller pairs 20, 21 with one pulse motor or to separately operate swinging of the rotary frame 80 and rotating of the roller pairs 20, 21.

Cards prepared in the card cassette 3 are fed to the turning unit F located at the downstream side as being separated one by one by the pickup roller 19 and a separating roller (idle roller) 9. Then, the card is introduced into the turning unit F by the roller pairs 20, 21 and posture thereof is deflected into a direction of a predetermined angle in a state of being nipped by the roller pairs 20, 21.

The magnetic recording portion 24, the non-contact type IC recording portion 23, the contact-type IC recording portion 27, and a reject stacker 25 are arranged at a periphery of the swinging direction of the turning unit F. The roller pairs 20, 21 form a medium introduction passage 65 on which a card is introduced toward any of the information recording portions 23, 24, 27. In the drawing, a bar code reader 28 is a unit which performs right-wrong determination (error determination), for example, while reading a later-mentioned bar code printed at the image transferring section B.

When a card with posture deflected into a direction of a predetermined angle by the turning unit F is conveyed to the magnetic recording portion 24, the non-contact type IC recording portion 23, or the contact-type IC recording portion 27 through the medium introduction passage 65 formed by the roller pairs 20, 21, data can be input to the card magnetically or electrically. Here, when a recording error occurs at the information recording portion 23, 24, 27, the card with the recording error is discharged to the reject stacker 25.

In FIG. 1, the turning unit F is turned as being oriented toward the non-contact type IC recording portion 23. The roller pairs 20, 21 form the medium introduction passage 65 to orient a card toward the recording portion 23. The non-contact type IC recording portion 23 is structured with an IC reader/writer substrate 67, an IC reader/writer antenna 69, and a medium conveyance path 68. The IC reader/writer antenna 69 transmits information transmitted from the IC reader/writer substrate 67 as a radio wave signal to an IC chip embedded in a card which is introduced to the medium conveyance path 68 through the medium introduction passage 65. Thus, the information is recorded in the IC chip.

Owing to that a shielding plate 70 which shields a radio wave signal from the IC reader/writer antenna 69 is arranged between the medium conveyance path 68 and the first medium conveyance passage P1, false recording to another card during being conveyed on the first medium conveyance passage P1 is prevented. The shielding plate 70 is formed of a shielding material (radio wave absorber). The shielding material selectively adopts a material which absorbs and shields radio waves in a specific band.

The standby section E and the image transferring section B are arranged at the first medium conveyance passage P1. The standby section E is arranged between the turning unit F and the transferring section B.

The standby section E is structured with conveying rollers (first roller pair) 29 and conveying rollers (second roller pair) 30 illustrated in FIG. 1. The image transferring section B is structured with a transfer platen (platen roller 31 in the drawing) to perform image transferring on a front face (lower face in FIG. 1) of a card with backup supporting.

The transfer film 46 is routed between the platen roller 31 and a heat roller 33. A later-mentioned film cassette 50 structuring the above is illustrated in the drawing. The film cassette 50 is arranged below the first medium conveyance passage P1 along with a later-mentioned cartridge (ribbon cassette) 42.

A film travel path P4 is formed so that the transfer film 46 loaded in the film cassette 50 travels between the platen roller 31 and the image forming section D. The image forming section D is arranged at a space below the first medium conveyance passage P1 where the standby section E is arranged. The image forming section D is structured with a platen roller (image forming platen) 45 and a thermal head 40 which is arranged as being faced to the platen roller 45 and an ink ribbon 41 is arranged to travel therebetween. A structure of the ink ribbon 41 will be described as a later-mentioned cartridge (ribbon cassette).

Thus, the turning unit F and the standby section E on the first medium conveyance passage P1 are placed above the image forming section D. The medium conveyance passages P2, P3 and the information recording section A (a magnetic recording mechanism and a contact type IC recording mechanism) thereon are placed beside the image forming section D. The cartridge 42 and the film cassette 50 are arranged in this order between the turning unit F on the first medium conveyance passage P1.

As described above, the first medium conveyance passage P1 and the second medium conveyance passage P2 are arranged in directions with different angles via the turning unit F. An intermediate transfer area is formed by arranging the cartridge 42 and the film cassette 50 in an area sandwiched by both the passages. The standby section E is placed on the first medium conveyance passage P1 between the turning unit F and the image transferring section B and the image forming section D is placed therebelow. The layout configuration described above enables the device to be aggregated and compactified. Further, owing to that the third medium conveyance passage P3 is arranged between the first medium conveyance passage P1 and the second medium conveyance passage P2 and the plural information recording portions (the magnetic recording portion 24 and the contact-type IC recording portion 27) are arranged thereat, the device can be further aggregated.

The conveying rollers (alternatively, belts) 29, 30 which convey a card are arranged at the first medium conveyance passage P1 and is connected to a conveying motor (not illustrated). The conveying rollers 29, 30 are roller pairs which nip and convey a card to be conveyed respectively with a pair of upper and lower rollers. The conveying rollers 29, 30 are configured to be switchable between forward rotation and reverse rotation to be capable of conveying a card from the image transferring section B to the turning unit F as being similar to conveying a card from the turning unit F to the image transferring section B. Further, a guide member 110 for skew correction (see FIG. 7) and a narrowing member 111 are arranged between the conveying rollers 29 (first roller pair) and the conveying rollers 30 (second roller pair) to correct skew of a card to be conveyed toward the image transferring section B. A specific structure and operation will be described later.

Further, the standby section E is arranged on the first medium conveyance passage P1 at the upstream side of the transferring section B. As described above, conveying rollers 29, 30 are arranged at the standby section E with a distance being smaller than a length of a card in the conveying direction. A card is temporarily on standby in a state of being held by the conveying rollers 29, 30 which are distanced in the front-rear direction. Specifically, later-mentioned skew correction and the like are performed by the narrowing member 111 during the above. Here, a transmission clutch (not illustrated) is arranged between a drive motor and the conveying rollers 29, 30. Accordingly, it is possible to cause a card to stop and wait when the clutch is in an OFF state. The first and second roller pairs 29, 30 are arranged between the turning unit F and the transferring section B which will be described later. Further, a sensor Se5 which detects entering and exiting of a card against the turning unit F is arranged between the turning unit F and the conveying rollers 29. Accordingly, existence of a card in the turning unit F can be detected.

In a state that a card is on standby at the standby section E, the front end of the card is located at the upstream side from the heat roller 33 which will be described later. According to the above, since the front end part of the card on standby is not heated by the heat roller 33, occurrence of unevenness of an image to be transferred to the card is prevented. Further, in a case that the front end of a card is curved, there is a fear that the transfer film 46 is damaged as being rubbed with the card when the card is kept waiting on the heat roller 33. In the present embodiment, since the standby section E is arranged at the upstream side of the transferring section B, the transfer film 46 is not damaged. Further, since the rear end of a card is located between the first roller pair 29 and the sensor Se5 (being in a state of having passed the sensor Se5) in a state that the card is on standby, no contact with the card occurs even when the turning unit F is swung during the card is on standby.

Owing to that the standby section E is arranged on the first medium conveyance passage P1 between the turning unit F and the transferring section B, an image forming job at the first medium conveyance passage P1 located at the downstream side can be controlled separately from a job to record magnetic information at the second medium conveyance passage P2 located at the upstream side and a job to record IC information at the third medium conveyance passage P3.

Accordingly, when a malfunction such as jamming occurs at the transfer film 46 in the image forming job at the first medium conveyance passage P1 located at the downstream side or when a malfunction occurs at the ink ribbon 41, it is possible to control stopping of the device after information recording job at the second medium conveyance passage P2 at the upstream side is completed without stopping the device.

[Image Transferring Section]

The image transferring section B is arranged on the first medium conveyance passage P1 at the downstream side of the standby section E. As illustrated in FIG. 1, the image transferring section B is structured with the platen roller 31 which backup-supports a card and the heat roller 33 is arranged as being faced to the platen roller 31. The heat roller 33 is lifted and lowered between a standby position distanced from the platen roller 31 and an operation position to pressure-nip a card with the platen roller 31.

Then, the transfer film 46 is routed in a travelable manner between the platen roller 31 and the heat roller 33. The heat roller 33 structured with a heating roller transfers imaged ink which is formed on the transfer film 46 onto a card surface with heating and melting by heating means arranged at the inside thereof. Here, at least one of the platen roller 31 and the heat roller 33 (transfer roller in the drawing) is rotationally driven. The speed thereof is set so that conveying speed of a card is matched with travel speed of the film. Further, the heat roller 33 is shifted from the standby state to the operation state at timing when the front end of the card conveyed by the conveying rollers 30 arrives at the platen roller 31.

Figure 4:
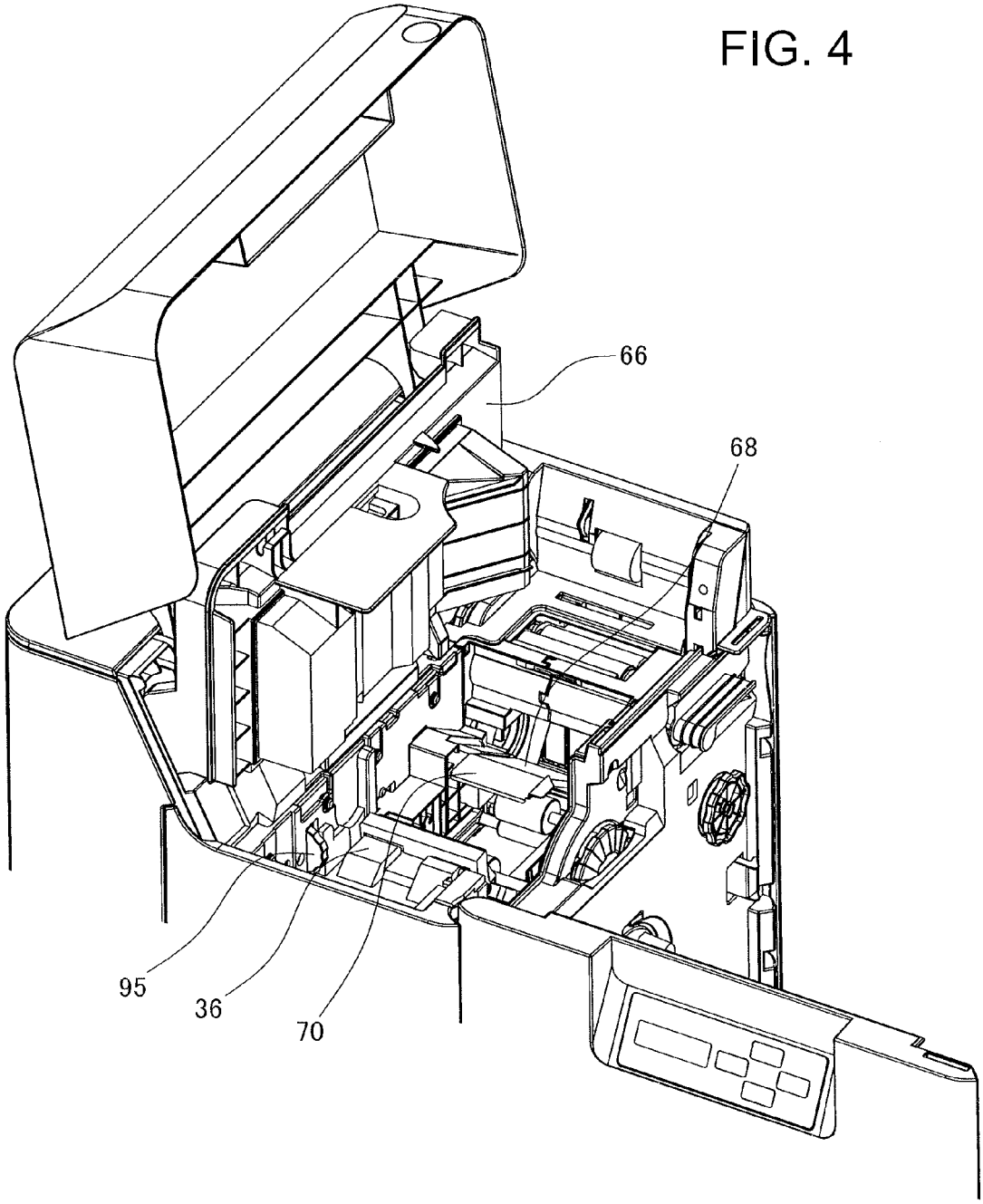
FIG. 4 is a view illustrating a state that the passage open-close member is opened.

Further, a lifting and lowering mechanism (not illustrated) is arranged at the heat roller 33 so as to be pressure-contacted to and distanced from the platen roller 31 arranged on the first medium conveyance passage P1 via the transfer film 46. Not illustrated in the drawing, the lifting and lowering mechanism is structured, for example, with a shift cam and a drive motor for rotating the shift cam. A dial 95 illustrated in FIG. 4 is interlocked with the lifting and lowering mechanism. The heat roller 33 can be lifted and lowered manually by rotating the dial 95.

A medium conveyance passage P1' for conveying a card to a storage stacker 60 is arranged at the downstream side of the image transferring section B. Conveying rollers (alternatively, belts) 37, 38 which convey a card are arranged at the medium conveyance passage P1' arranged at the downstream side of the first medium conveyance passage P1 and is connected to a conveying motor (not illustrated).

A de-curl mechanism 36 including a pressing portion 74 and a receiving portion 73 is arranged between the conveying roller 37 and the conveying roller 38 and corrects a curl caused by thermal transfer by pressing a center part of a card held between the conveying rollers 37, 38. The de-curl mechanism 36 is configured to be movable in the up-down direction in FIG. 1 with a lifting and lowering mechanism (not illustrated) such as a cam.

The pressing portion 74 of the de-curl mechanism 36 is depressed by the lifting and lowering mechanism in a state that a card to be de-curled is nipped between the conveying roller 37 and a nip roller and between the conveying roller 38 and a nip roller 72. Subsequently, the receiving portion 73 is moved downward along with the nip rollers 71, 72 while receiving the pressing portion 74. According to the above, since nipping of the card between the conveying roller 37 and the nip roller 71 and between the conveying roller 38 and the nip roller 72 is released, appropriate curl correction can be performed.

[Image Forming Section]

The image forming section D forms an image such as a face photograph and character data on front and back faces of a card. In the drawings, the device is illustrated as a case to form an image with a sublimation ink cartridge. The thermal head 40 and the ink ribbon 41 are arranged at the image forming section D. The ink ribbon 41 is stored in the cartridge 42. The cartridge 42 contains a feeding roll 43 and a winding roll 44. A winding motor Mr1 is connected to the winding roll 44.

The thermal head 40 is arranged a position being faced to the platen roller 45. A head control IC 74*x* (see FIG. 15) is connected to the thermal head 40 for performing thermal control thereof. The head control IC 74*x* performs thermal control of the thermal head 40 in accordance with image data, so that an image is formed on the later-mentioned transfer film with the ink ribbon 41. The winding roll 44 is configured to wind the ink ribbon 41 at predetermined speed as being rotated in synchronization with the thermal control of the thermal head 40. Here, a cooling fan 39 cools the thermal head 40 and discharges heat generated in the device to the outside.

The transfer film 46 is wound to a winding roll 47 and a feeding roll 48 and routed so that a transfer image is conveyed to the platen roller 31 and the heat roller 33. Pinch rollers 32*a*, 32*b* are arranged at a circumference of a conveying roller 49 for the transfer film 46. A drive motor (not illustrated) is connected to the conveying roller 49. The transfer film 46 is moved counterclockwise in FIG. 1 at constant speed along with the ink ribbon 41. In the drawing, an existence detecting sensor Seg for the transfer film 46 and a position detecting sensor Se10 for the ink ribbon 41 are illustrated. A card to be conveyed through the medium conveyance passage P1 is conveyed to the platen roller 31 by the conveying rollers 30 and thermal transfer of the image on the transfer film 46 is performed by the heat roller 33.

Figure 5:
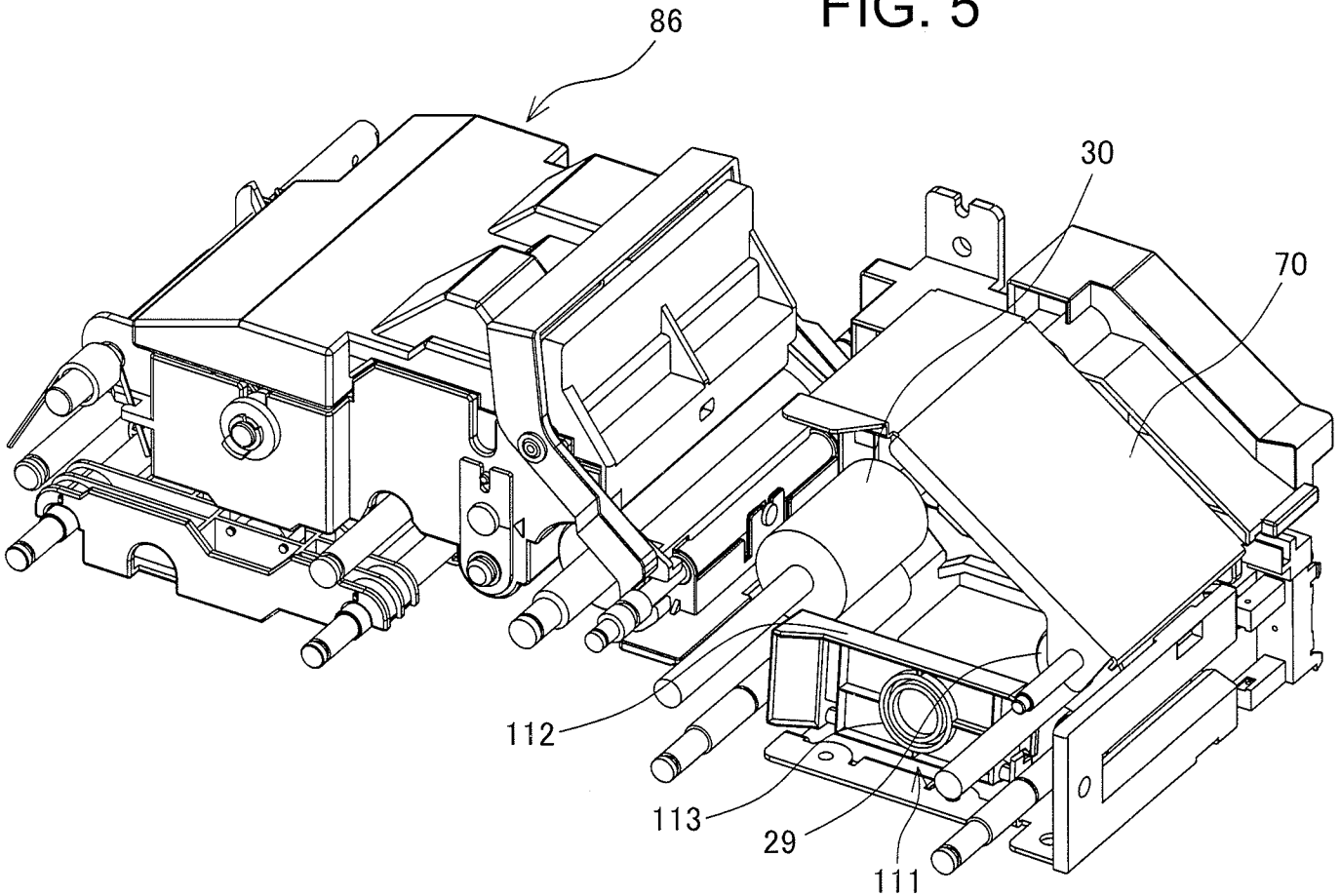
FIG. 5 is a view illustrating a shielding plate and de-curl mechanism located on a medium conveyance passage.
Figure 6:
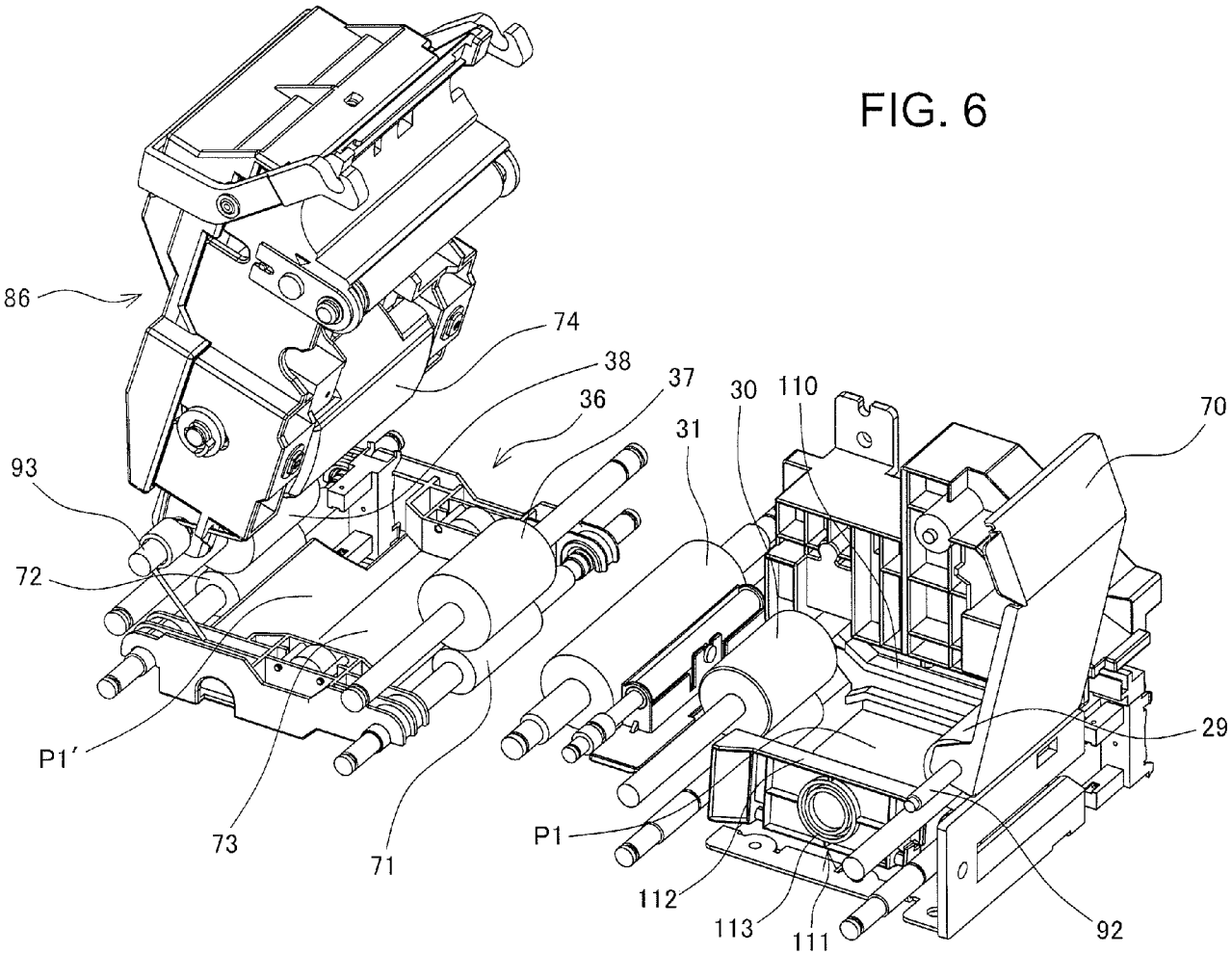
FIG. 6 is a view illustrating a state that the shielding plate and a frame unit of the de-curl mechanism are opened respectively.

FIGS. 5 and 6 illustrate specific structure of the conveying rollers 29 (first roller pair) arranged along the medium conveyance passages P1, P1', the guide member 110 for skew correction, the narrowing member 111, the conveying rollers 30 (second roller pair), the platen roller 31, and the de-curl mechanism 33. Here, the shielding plate 70 and an upper unit of the de-curl mechanism 36 having upper and lower units rotatably separated can be opened upward respectively. FIG. 5 illustrates a closed state and FIG. 6 illustrates an opened state. The medium conveyance passages P1, P1' appear in the opened state.

[Storage Section]

As illustrated in FIG. 1, a storage section G is configured to store cards conveyed from the image transfer section B at the storage stacker 60. The storage stacker 60 is configured to be lowered to the lower side in FIG. 1 by a lifting and lowering mechanism 61 while detecting an uppermost card by a level sensor.

[Film Cassette]

Description will be performed on the film cassette 50 in which the transfer film 46 is loaded. As illustrated in FIG. 1, the film cassette 50 is structured as a unit which is separated from the device housing 2 and is attached to the device housing 2 in a detachably attachable manner. A front cover (not illustrated) is arranged at the surface side of FIG. 1 in an openable and closable manner. The film cassette 50 is to be attached to the device frame in a state that the front cover is opened.

The winding roll 47 and the feeding roll 48 are attached to the film cassette 50 in a detachably attachable manner. In the present device, an image on the transfer film 46 is transferred to a card while winding the transfer film 46 with the winding roll 47. Therefore, a peeling roller 34 is arranged at the downstream side from the transfer film 46 at the time of transferring in the film conveying direction (at the side of the winding roll 47 from the heat roller 33).

The transfer film 46 routed as described above is engaged with the conveying roller 49 and the pinch rollers 32*a*, 32*b* which are arranged at the device side. Here, the conveying roller 49 and an operational rotary shaft (not illustrated) which is connected to the winding roll 47 and the feeding roll 48 are operationally rotated so that the film travels at constant speed.

The film travel path P4 is formed so that the transfer film 46 loaded in the film cassette 50 travels between the platen roller 31 and the image forming section D. The image forming section D is arranged at a space below the conveyance passage where the standby section E is arranged. The image forming section D is structured with the platen roller 45 and the thermal head 40 which is arranged as being faced to the platen roller 45 and the ink ribbon 41 is arranged to travel therebetween. A structure of the ink ribbon 41 and the cartridge 42 will be described later.

[Jammed Card Removing Mechanism]

Description will be performed on a structure to remove a card which is conveyed from the card cassette 3 to the image transferring section B and jammed at the medium conveyance passage P1, P1' among the whole structure of the information recording device 1 according the present invention.

As illustrated in FIG. 2, when the card cassette 3 is detached from the cassette mount area 100 of the device housing 2, there appears a passage open-close member 66 which is located below the card cassette 3. An upper face cover 90 of the passage open-close member 66 is a lid as forming a separation wall (bottom face wall) of the cassette mount area 100. Here, the passage open-close member 66 is attached to the device housing 2 in an openable and closable manner. In the present embodiment, an end part thereof in the longitudinal direction is rotatably supported by the device housing 2.

Figure 3:
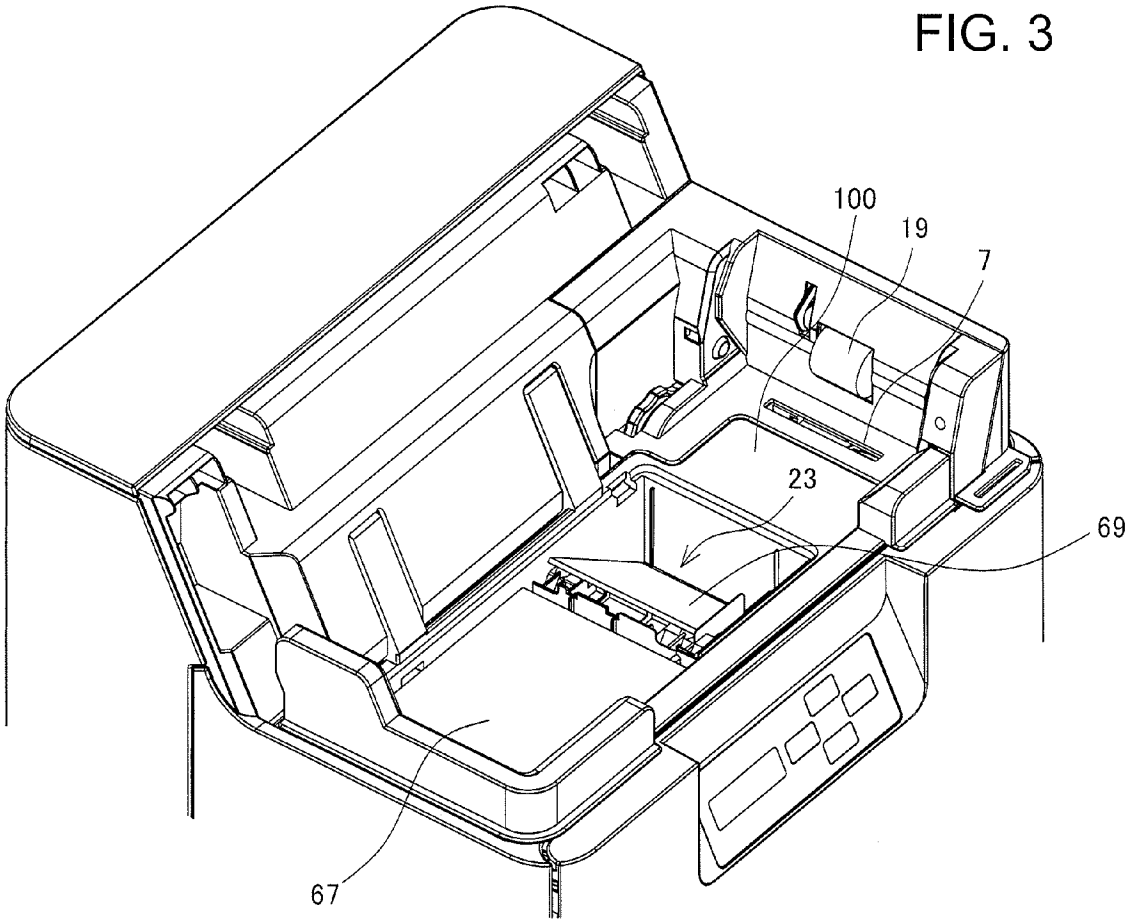
FIG. 3 is a view illustrating a state that a lid of a passage open-close member is removed.

Further, when the upper face cover 90 of the passage open-close member 66 is detached, it is recognized that the IC reader/writer substrate 67 of the non-contact type IC recording portion 23 and the IC reader/writer antenna 69 are embedded, as illustrated in FIG. 3. When the passage open-close member 66 is opened as illustrated in FIG. 4, the IC reader/writer substrate 67 and the IC reader/writer antenna 69 are displaced and the medium conveyance path 68, the shielding plate 70, and portions of the medium conveyance passages P1, P1' are exposed. Accordingly, a card jammed at the exposed section can be removed. FIG. 5 illustrates the shielding plate 70 and the de-curl mechanism 36 which are located at the medium conveyance passages P1, P1'.

In FIG. 6, the shielding plate 70 is rotatably supported by the device frame with a shaft 92 which is arranged at one end thereof. When the shielding plate 70 is opened having the shaft 92 as a fulcrum, the medium conveyance passage P1 formed by the rollers 29 and the rollers is completely exposed to be accessible from the outside. Accordingly, a jammed card can be removed.

In the de-curl mechanism 36, a unit frame 86 is structured by integrating the pressing portion 74 and the lifting and lowering mechanism which moves the pressing portion 74 in the up-down direction. Then, the unit frame 86 is rotatably supported by the device frame with a shaft 93 which is arranged at one end thereof. In a state that the unit frame 86 is opened, the medium conveyance passage P1' formed by the roller 37 and the roller 38 is completely exposed to be accessible from the outside. Accordingly, a jammed card can be removed similarly.

When an error occurs in a state that a card is nipped between the heat roller 33 and the platen roller 31, the jammed card is required to be removed while the nipping is released. For releasing the nipping between the heat roller 33 and the platen roller 31, the heat roller 33 is lowered by rotating the dial 95 (FIG. 4) which is interlocked with the lifting and lowering mechanism (not illustrated) for the heat roller 33. Thus, the card can be removed.

As described above, in the present embodiment, owing to that the IC reader/writer substrate 67 and the IC reader/writer antenna 69 of the non-contact type IC recording portion 23 are embedded in the passage open-close member 66, it is possible to remove a card jammed at the medium conveyance path 68 of the non-contact type IC recording portion 23 when the passage open-close member 66 is opened. Here, the similar structure can be adopted for other electronic information recording means as long as being with a non-contact type recording method.

[Skew Correction Mechanism]

Next, description will be performed in the following on a specific structure and operation for correcting skew of a card conveyed from the card cassette 3 at the image transferring section B on the medium conveyance passage P1 among the whole structure of the information recording device 1 according to the present invention.

In the information recording device, if skew of a card occurs when the card is conveyed toward a thermal transferring device or a printer, there is a fear of malfunction occurrence such that thermal transferring or printing onto a card surface is strained when the card is conveyed to the thermal transferring device or the printer.

There is known a card processing device which includes a skew preventing device to correct card posture during conveyance. For example, Patent Literature 2 (Japanese Patent Application Laid-Open No. 7-271923) discloses a card handling device which prevents printing errors such as skew printing on a card surface and printing lying off a defined frame owing to that a pair of reference guides are arranged to restrict card conveying direction and that a card conveyed to a print position is moved toward either reference guide by a narrowing mechanism.

In such information recording devices including the device of Patent Literature 2, a card is moved as being conveyed by a plurality of conveying rollers which are arranged along the conveying direction. Here, the respective conveying rollers are configured to convey a card as nipping with a pair of rollers.

Therefore, even if skew is to be prevented by moving a card during conveyance toward one reference guide by the narrowing mechanism in a state that the card is nipped by the conveying rollers, there is a case that correction by the narrowing with the narrowing operation is insufficient when a nipping force of the card due to the conveying rollers is large. A countermeasure to enlarge pressing pressure of the narrowing mechanism to a card subsequently causes a card to be folded and damaged.

When the nipping force of a card due to the conveying rollers is lessened, there arises a problem that card conveyance to a thermal transferring device or a printer becomes unreliable due to slipping and the like and that timing of processing onto a card surface is mismatched.

In consideration of the above, the present embodiment has a structure described below to reliably convey a card while skew is corrected at appropriate posture during conveyance.

Figure 7:
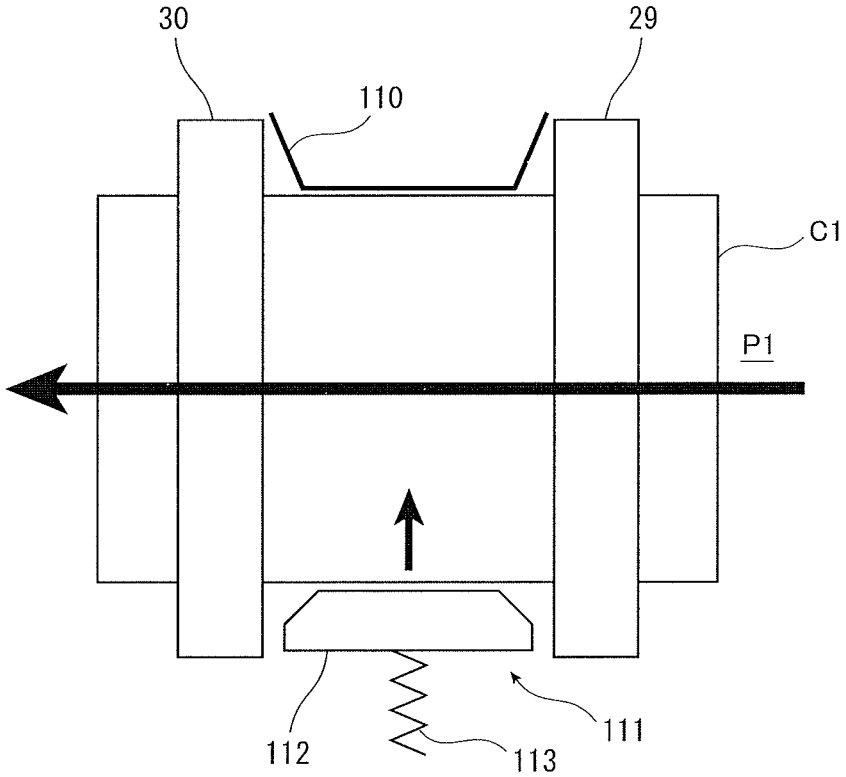
FIG. 7 is an explanatory plane view illustrating a portion for skew correction in the information recording device according to the present invention.

FIG. 7 is a plane view of the medium conveyance passage P1 viewing FIG. 1 from the upper side. As illustrated in FIG. 7, skew correction means is arranged on the medium conveyance passage P1 between the conveying rollers 29 (first roller pair) and the conveying rollers 30 (second roller pair). Specifically, the skew correction means is structured with the guide member 110 and the narrowing member 111. The guide member 110 is arranged at one side of the medium conveyance passage P1 along the card conveying direction (the direction of an arrow in FIG. 7). Further, the narrowing member 111 is arranged at the other side of the medium conveyance passage P1 as being faced to the guide member 110. The narrowing member 111 includes a pressing member 112 which presses a side face of a card C1 to the guide member 110 as sandwiching the medium conveyance passage P1 and an urging member 113 which urges the pressing member 112 toward the guide member 110 as being structured with a spring and the like. In this manner, the narrowing member 111 is configured to moving the card C1 passing through the medium conveyance passage P1 toward the guide member 110 with pressing pressure of the pressing member 112 which is urged by the urging member 113.

Further, a nipping force (nipping pressure) of the conveying rollers 30 (second roller pair) is set larger than a nipping force (nipping pressure) of the conveying rollers 29 (first roller pair). The nipping force capable of reliably conveying the card C1 while preventing slipping at the image transferring section B is applied to the conveying rollers 30 by adjusting dimensions between the pair of rollers, a roller diameter, and an urging force between the rollers. Meanwhile, the conveying rollers 29 with the nipping force (nipping pressure) to the card smaller than that of the conveying rollers 30 is set to have the nipping force to the extent to be capable of correcting conveyance posture to be matched with the conveying direction while the card C1 is easily moved when the card C1 is pressed by the narrowing member 111 toward the guide member 110.

Figure 8:
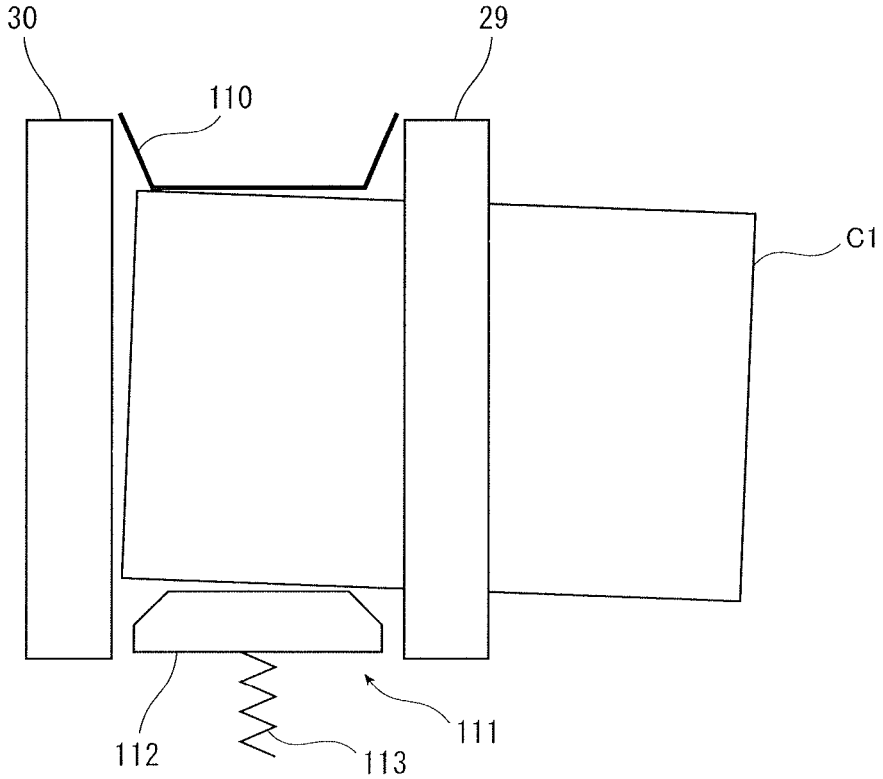
FIG. 8 is an explanatory plane view illustrating the portion for skew correction in the information recording device according to the present invention.

Accordingly, even when the card C1 is conveyed to the medium conveyance passage P1 in a skewed state as illustrated in FIG. 8, since the card C1 is conveyed only by the conveying rollers 29 having the small nipping force before arriving at the conveying rollers 30, the card C1 is conveyed as being easily corrected by the narrowing member 111. When the skew-corrected card C1 arrives at the conveying rollers 30 and is conveyed by the conveying rollers 30, the card C1 can be reliably conveyed to the platen roller 31 and the heat roller 33 while preventing slipping with the large nipping force.

The card C1 is guided by the guide member 110 even when the card C1 is conveyed only by the conveying rollers 29. Therefore, although nipping force of the conveying rollers 29 is smaller than that of the conveying rollers 30, the card C1 is reliably conveyed in the conveying direction without being laterally swayed. Nevertheless, when the nipping force of the conveying rollers 29 is excessively small, it is difficult to perform appropriate conveying as being influenced by slipping, pressing pressure of the narrowing member 111, and the like. Therefore, the nipping force of the conveying rollers 29 is required to be ensured to some extent. With the above, there may be a case that correction is performed insufficiently when the card C1 is conveyed in a state of being largely displaced.

Figure 9A:
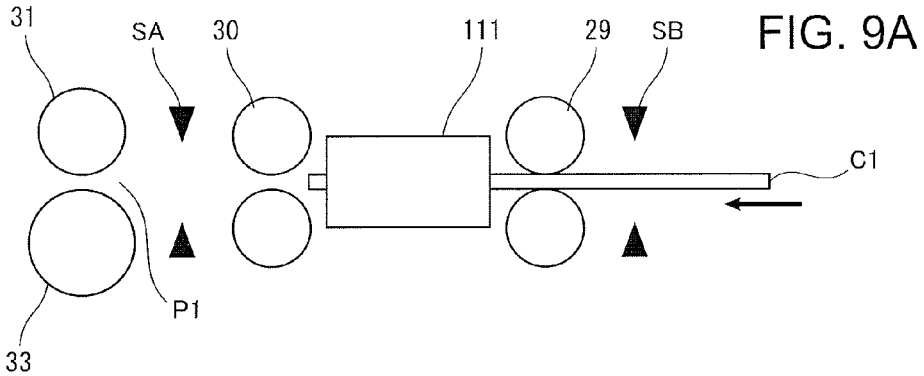
FIGS. 9A to 9D are explanatory views schematically illustrating flow of skew correction operation.
Figure 9B:
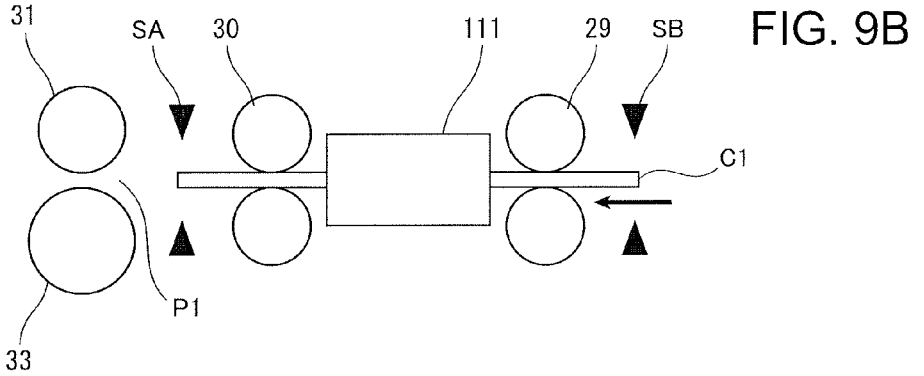
Figure 9C:
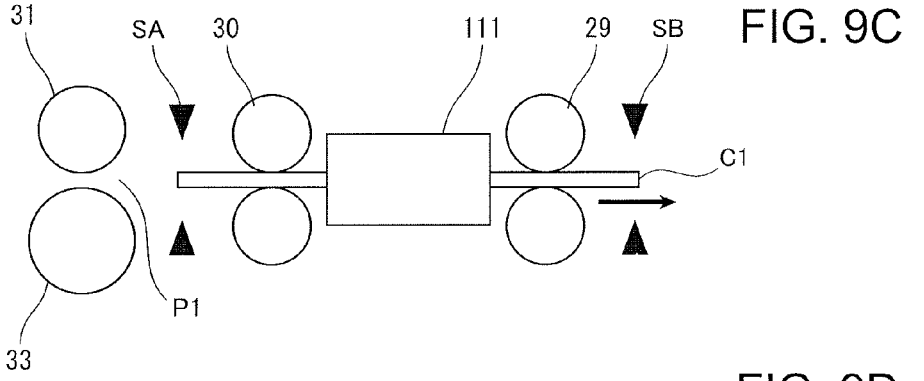

In consideration of the above, in the present embodiment, reliable correction is further achieved by repeating skew correcting with reciprocating conveyance of the card C1. That is, as illustrated in FIGS. 9A and 9B, the first correction of the card C1 is performed by cooperation of sole nipping by the conveying rollers 29 and narrowing operation of the narrowing member 111 when the card C1 is conveyed in a direction (forward direction) toward the platen roller 31 and the heat roller 33 (FIG. 9A). Subsequently, when arrival of the card C1 as being nipped by the conveying rollers 30 is detected by a sensor SA (FIG. 9B), the conveying rollers 29, 30 are reversely rotated to reversely convey the card C1 in the reverse direction of being apart from the platen roller 31 and the heat roller 33 (FIG. 9C). When the card C1 is nipped solely by the conveying rollers 29 in the reverse conveyance process, the second correction is performed by the narrowing member 111. Here, when conveying speed is controlled to be lowered compared to the case of forward conveyance as in FIG. 9A, a narrowing period due to the narrowing member 111 is prolonged and further correction can be reliably achieved.

When a certain period of time passes after the reversely conveyed card C1 is detected by a sensor SB (FIG. 9D), the conveying rollers 29, 30 are forwardly rotated once again to forwardly convey the card C1 toward the platen roller 31 and the heat roller 33. Correction is performed at this time as being repetition of FIG. 9A. Subsequently, when nipped again by the conveying rollers 30, the card C1 is reliably conveyed to the image transferring section B with the large nipping force while being maintained at appropriately corrected posture.

Figure 9D:
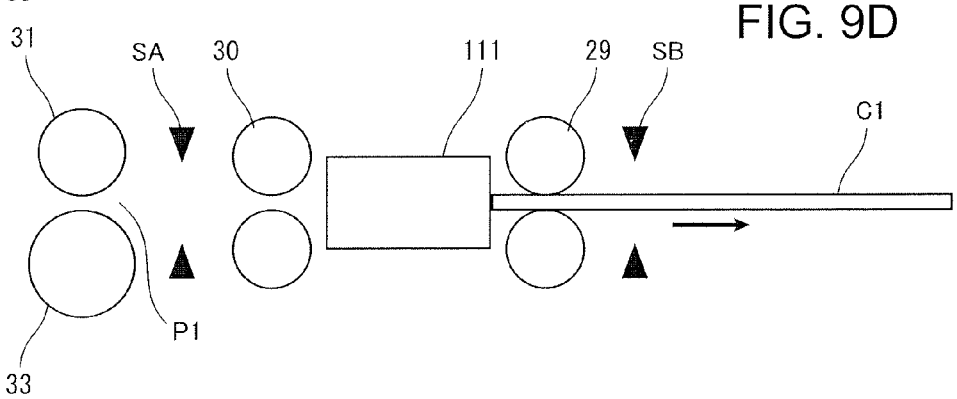
Figure 10A:
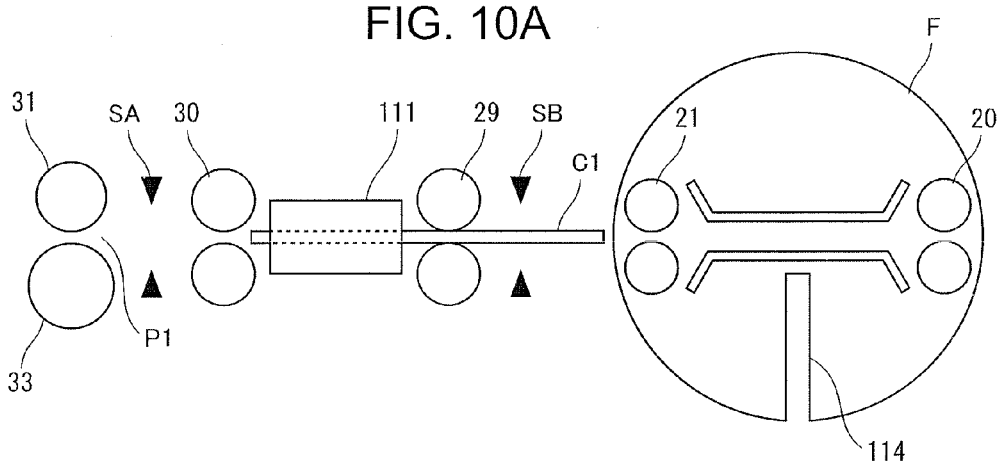
FIGS. 10A and 10B are explanatory views schematically illustrating a structure and operation for correcting skew of a card having a long side in a conveying direction.

A movement distance of the card C1 due to reverse conveyance illustrated in FIG. 9D is set to be controlled based on a length of a side of the card C1 along the conveying direction. Here, in a case of the card C1 having a long side along the conveying direction, skew correction with reverse conveyance naturally becomes insufficient unless a returning amount due to the reverse conveyance is enlarged. Then, there may be a case that a rear end part of the card C1 is returned to the roller pair 21 of the turning unit F, as illustrated in FIG. 10A. In such a case, the card C1 is to be held also by the roller pair 21 or the roller pair 20 in the turning unit F. Therefore, it is not possible to perform correction of card posture with cooperation of sole nipping by the conveying rollers 29 and narrowing operation of the narrowing member 11.

Figure 10B:
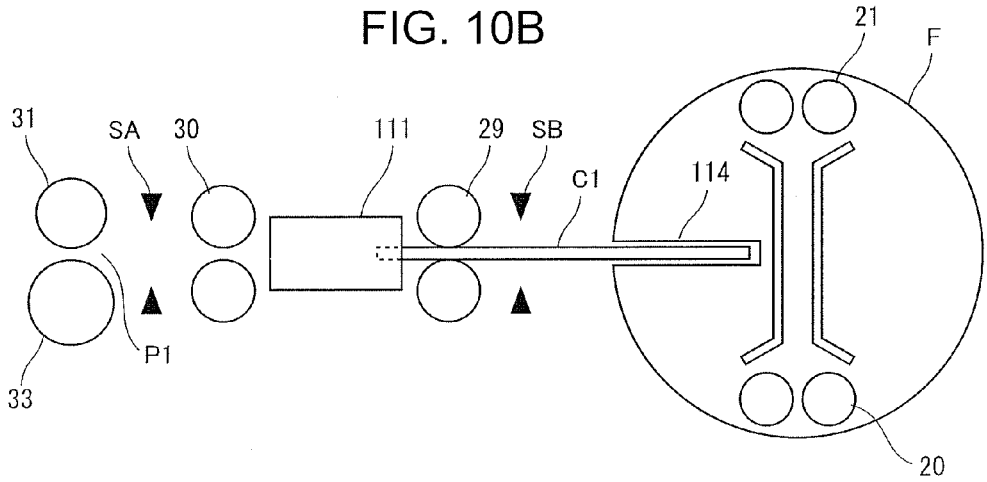

In consideration of the above, a cutout portion 114 is formed at the turning unit F, and then, the turning unit F is controlled to be rotated to a position illustrated in FIG. 10B so that the rear end part of the card C1 enters to the cutout portion 114 when the card C1 is reversely conveyed for skew posture correction. According to the above, nipping solely by the conveying rollers 29 can be performed even with a card having a long side along the conveying direction, so that skew correction can be reliably performed.

As described above, in a case that the roller pairs 20, 21 are located in the turning unit F, it is only required to form the cutout portion 114 at the turning unit F and to rotate the turning unit F. In a case of an information recording device without having the turning unit F or in a case that roller pairs similar to the roller pairs 20, 21 are arranged between the conveying rollers 29 and the turning unit F even when the turning unit F exists, it is only required to arrange a moving mechanism to cause the roller pairs to retreat from the medium conveyance passage P1.

Further, the movement distance of the card C1 during reverse conveyance illustrated in FIG. 9D may be set as being determined in accordance with a thickness or stiffness of the card C1. That is, in a case of a thin card or a low-stiffness card, there is a fear that damages, deformation, and the like is caused with the card when a pressing force of the narrowing member 111 is large. Therefore, the pressing force of the narrowing member 111 is controlled in accordance with the thickness or stiffness of the card C1. Here, in order to reliably correct skew of the card C1 with the narrowing member 111 when the pressing force is set small, the pressing member 112 is required to be pressed to the card C1 in a longer period than a case with a large pressing force of the narrowing member 111. Thus, skew correction can be reliably performed even with a thin card or a low-stiffness card by prolonging the reverse conveyance distance of the card C1. Naturally, it is possible to obtain the similar effects by decreasing conveying speed of the card C1 during reverse conveyance.

As described above, in the present embodiment, the skew correction means is arranged between the pair of the conveying rollers 29 (first roller pair) and the pair of conveying rollers 30 (second roller pair) which convey a card to a thermal transferring device to record image information on a surface of a card being a recording medium, and then, the nip pressure of the conveying rollers 30 for the card is set larger than the nip pressure of the conveying rollers 29. According to the above, skew of the card is to be corrected owing to action of the guide member 110 and the narrowing member 111 when the card is conveyed as being nipped solely by the conveying rollers 29.

The skew correction means is structured with the guide member 110 which is arranged at one side of the medium conveyance passage P1 along the conveying direction and the narrowing member 111 which is arranged at the other side of the medium conveyance passage P1 in the conveying direction to press the card to the guide member 110. In this manner, skew correction can be appropriately performed by pressing the conveyed card in a direction perpendicular to the medium conveyance passage P1.

For further improving correction reliability, the card is once reversely conveyed to be returned in a state of being nipped solely by the conveying rollers 29 after the card forwardly conveyed toward the platen roller 31 of the image transferring section B arrives at the nipping position of the conveying rollers 30, while correction is performed again by the skew correction means. When the reverse conveying speed is set to be lower than the forward conveying speed, the effect of the subsequent correction is further enhanced. In addition, owing to that the movement distance of the card during reverse conveyance is varied in accordance with a length of the card in the conveying direction and a thickness or stiffness of the card, skew correction can be reliably performed while preventing card deformation and print failure.

Then, the corrected card is reliably conveyed to the platen roller 31 and the heat roller 33 of the image transferring section B while preventing slipping and the like with the large nipping force of the conveying rollers 30. In the above description of the present embodiment, the recording device to record information on a card surface is the thermal transferring device including the platen roller 31 and the heat roller 33. The usefulness therefor is the same for a printer to record print information on a card surface. Here, a card is conveyed to the printer at appropriately corrected posture, so that print failure on the card surface can be prevented.

In the above description of the present embodiment, a card is conveyed in the forward direction (FIG. 9A), the card is nipped by the conveying rollers 30 (FIG. 9B), and then, the card is conveyed in the direction opposite to the direction of being apart from the platen roller 31 and the heat roller 33 with reverse rotation of the conveying rollers 29, 30 (FIG. 9C). Here, it is also possible that the card is once conveyed to the medium conveyance passage P1' and is reversely conveyed to be nipped again by the conveying roller pairs 29, 30 (FIG. 9B). For example, in a case that the non-contact IC read/write portion is arranged on the medium conveyance passage P1' (the downstream side of the image transferring section B), it is also possible that a card is reversely conveyed after receiving the non-contact IC read/write process as once passing through the conveying rollers 29, 30 and that the skew correction operation in FIG. 9C and after is performed after being in the state of FIG. 9B.

At that time, the card conveying speed during the skew correction operation in FIG. 9C and after is controlled to be lower than the card conveying speed from feeding and conveying the card to the medium conveyance passage P1' until the card is nipped by the conveying roller pairs 29, 30 as being reversely conveyed.

Further, in the above description of the present embodiment, the card feeding direction is the same as the card conveying direction during image forming. However, it is also possible that the card feeding direction is different from the card conveying direction during image forming. In this case, the card conveying speed during the subsequent skew correction operation is set to be lower than the conveying speed from feeding the card until the card is nipped by the conveying roller pairs 29, 30 as passing through the image forming section B.

According to the present embodiment, in a medium processing device including the recording device to record information on a surface of a recording medium, the nipping pressure of the second roller pair arranged at the upstream side to convey a card or the like for nipping the recording medium is set to be larger than the nipping pressure of the first roller pair arranged at the downstream side for nipping the recording medium. Accordingly, the card conveyed to the recording device is set at appropriate posture while correcting skew, so that information recording can be appropriately performed on the surface of the recording medium while preventing a malfunction such as print strain.

In addition, skew correction can be reliably performed on any kind of cards or the like with plurally-repeated opportunities of skew correction of the cards or the like not being only once.

[Attaching and Detaching Mechanism of Information Recording Unit]

Next, description will be performed on a structure to attach and detach the information recording unit (the magnetic recording portion 24 and the contact-type IC recording portion 27) among the whole structure of the information recording device 1 according to the present invention. In the following, prior to the above, a structure of the cartridge 42 will be described first.

As illustrated in FIG. 1, the feeding roll 43 and the winding roll 44 is rotatably assembled into the cartridge 42. The film-shaped ink ribbon 41 is wound between the feeding roll 43 and the winding roll 44. For example, the ink ribbon 41 is a sublimation ribbon in which belt-shaped ribbons of yellow (Y), magenta (M), cyan (C), and black (B) are formed. Then, the ink ribbon 41 is wound to the feeding roll 43 in a roll-like manner.

The cartridge 42 is attached to the device housing 2 in a detachably attachable manner in the front-back direction of paper of FIG. 1. The ink ribbon 41 is inserted between the platen roller 45 and the thermal head 40 which are mounted on the device housing 2. Further, the winding roll 44 is engaged with a winding motor Mr1 which is mounted on the device housing via a coupling (not illustrated). A head lifting and lowering mechanism (not illustrated) is arranged so that the thermal head 40 is on standby at a standby position as being apart from the platen roller 45 when attaching the cartridge 42.

As illustrated in FIG. 1, the feeding roll 43 and the winding roll 44 are arranged in the passage direction of the second medium conveyance passage P2 (vertical direction). Meanwhile, also in the film cassette 50 described above, the feeding roll 48 and the winding roll 47 are arranged in the same direction (vertical direction). Owing to that the feeding roil 43 and the winding roll 44 of the cartridge 42 and the feeding roll 48 and the winding roll 47 of the film cassette 50 are arranged in the direction being approximately in parallel to the passage direction of the second medium conveyance passage P2, aggregation of the device can be achieved.

In general, an information recording device which records information on a recording medium such as a plastic card and a thick-paper card has been widely known as a device to record information on a card or the like which is to be used as a card for every kind of identification, a credit card for commercial payment, of the like. A magnetic reader/writer unit to magnetically record information, an IC reader/writer unit to electrically record information, a printing unit to record character image information, and the like are known as an information recording unit for the above.

For example, Patent Literature 3 (Japanese Patent Application Laid-Open No. 2000-187712) discloses a device which concurrently performs recording of magnetic information and recording of image information while a card conveyed from a card cassette which stores a plurality of cards is guided to a magnetic recording portion and an image recording portion. Similarly, Patent Literature 4 (Japanese Patent Application Laid-Open No. 2001-063893) also discloses a device which concurrently performs recording of magnetic information and recording of image information.

Such a device to form image information and magnetic information or IC information concurrently on a card has been known as a terminal device of a card issuing system, for example. Patent Literature 3 proposes a device including a card feeding stacker, a magnetic recording unit arranged on a conveyance path for a card fed from the stacker, and an image forming platen arranged at the downstream side thereof. Further, Patent Literature 4 discloses a device in which cards fed from a card hopper is conveyed to be distributed to a magnetic recording passage and an image forming passage by a turning unit and magnetic information recording and image information recording are performed at the respective passages.

Such an information recording device requires a reader/writer unit corresponding to a card issuing system to be mounted thereon. Here, except for a printing unit to record image information on a card, a magnetic recording unit and an IC recording unit are attached to the device as optional units in a detachably attachable manner.

For attaching an optional unit to the device in a detachably attachable manner, an open-close door is arranged at an external housing of the device and the unit is attached into the device with the door opened. In general, such a device requires plural kinds of units or cassettes which are to be attached to and detached from the housing, such as a magnetic reader/writer unit, an IC reader/writer unit, and an ink ribbon cartridge for image forming.

Therefore, a plurality of open-close doors are required to be arranged at the housing and strength of a device frame is undermined. In addition, there arises a problem of arrangement of components to be arranged inside the housing, for example, harness components and the like.

The inventors have noticed that an insertion opening can be reduced in size owing to that, posture of insertion through the opening of a housing and attached posture therein are differentiated for an optional unit to be attached into the housing.

In the present embodiment, the information recording unit can be easily attached to and detached from the inside of the housing which structures the external housing of the device and the housing is formed small, compact, and rigid.

Figure 12:
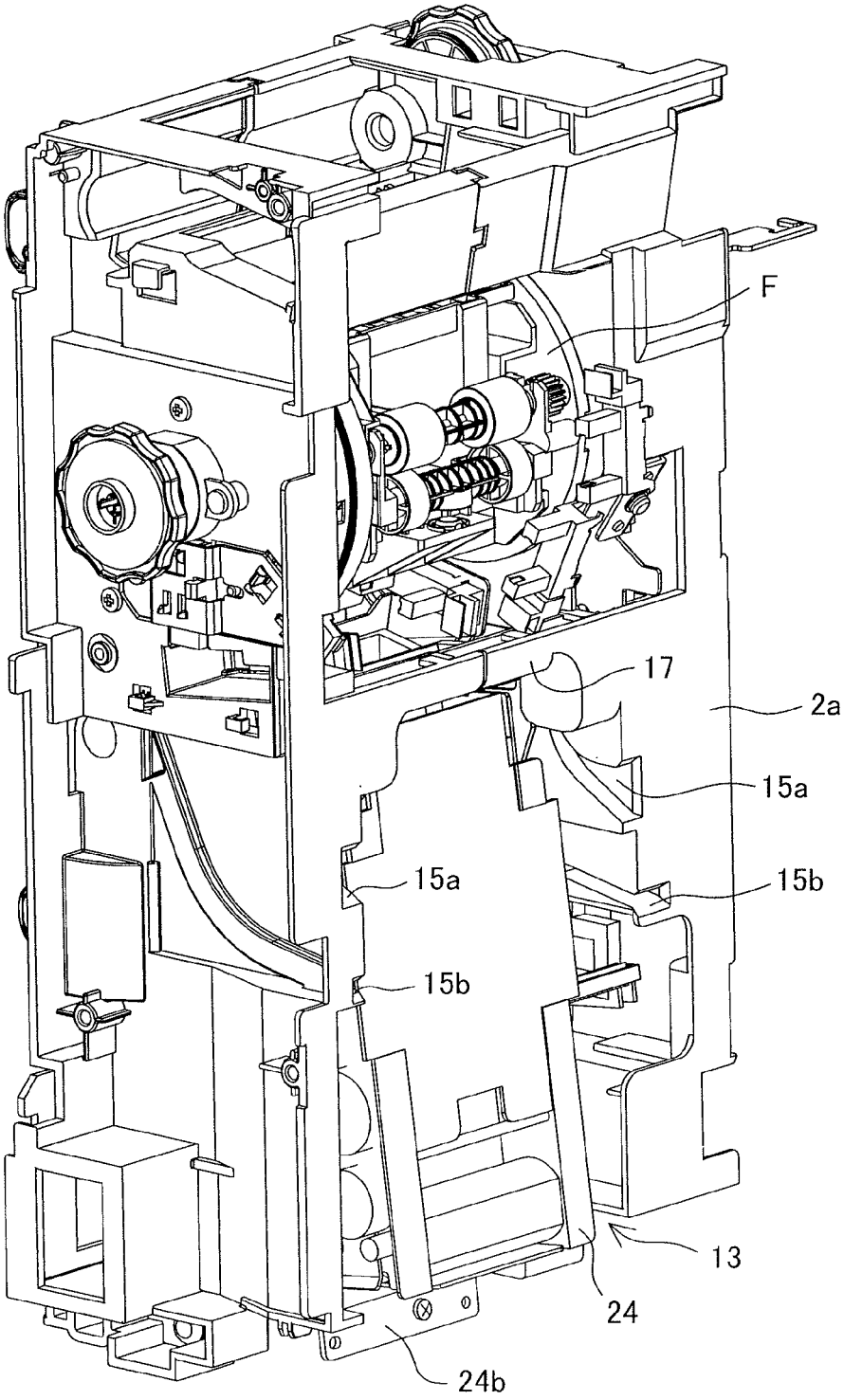
FIG. 12 is a view illustrating an attached state of a magnetic recording unit in the device in FIG. 1.

The present embodiment relates to a structure for attaching the magnetic recording portion 24 (hereinafter, called the magnetic recording unit) into the device housing 2 in a detachably attachable manner. As illustrated in FIG. 12, a unit insertion opening 13 (hereinafter, called the insertion opening) is arranged at the outer plate 2*a* of the device housing 2 and an open-close cover 14 (FIG. 13A) is arranged at the insertion opening 13. Meanwhile, a unit attaching portion 2*x* (FIG. 13A) is arranged at the device frame (not illustrated) and attaching and detaching of the magnetic recording unit 24 is performed through the insertion opening 13 of the device housing 2.

Figure 13A:
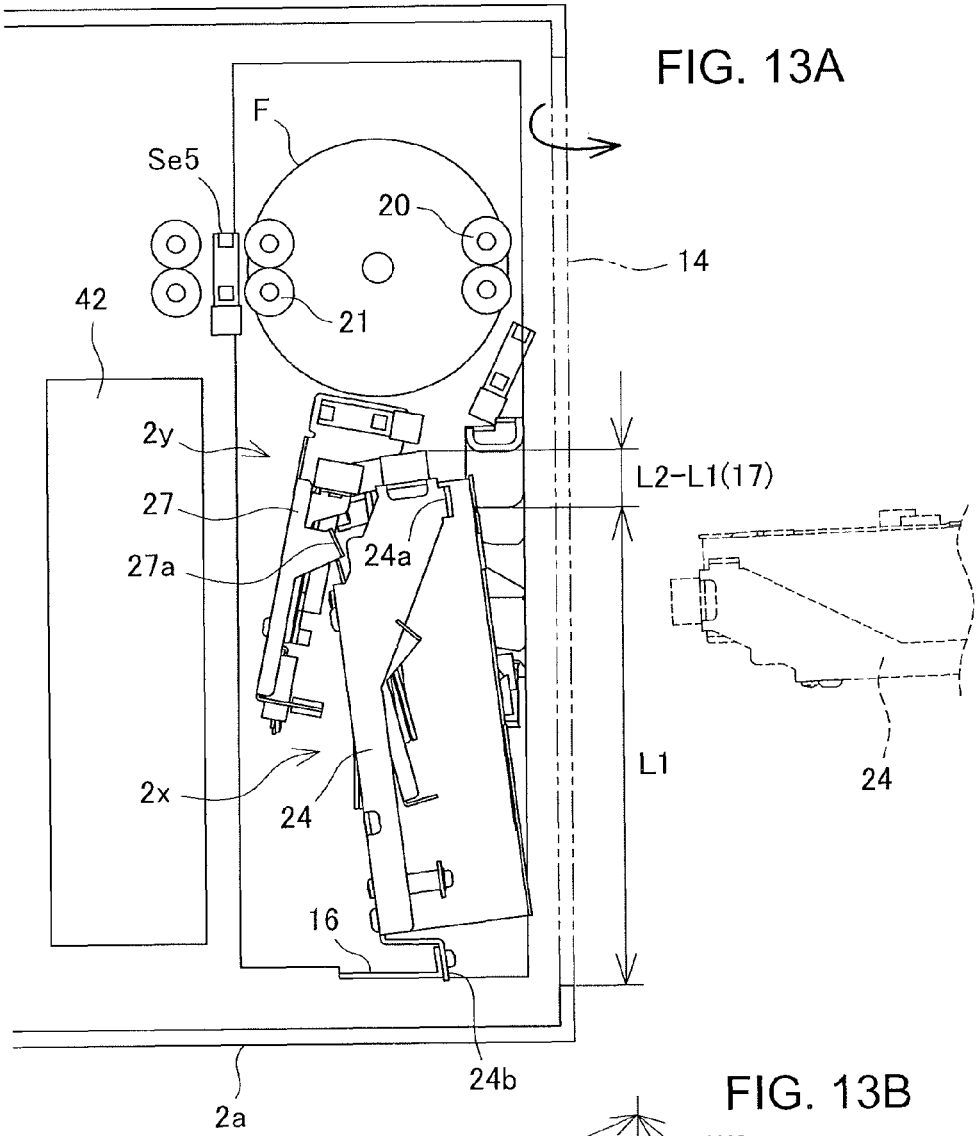
FIG. 13A is a detailed explanatory view of a unit attaching portion and FIG. 13B is a whole perspective view of the magnetic recording unit.

The insertion opening 13 is arranged so that insertion posture (illustrated by broken lines in the drawing) of the magnetic recording unit 24 while being inserted and attached posture (illustrated by solid lines in the drawing) thereof as being attached into the device housing are differentiated in position against the unit attaching portion 2*x* as illustrated in FIG. 13A. In the device in the drawing, the magnetic recording unit 24 having a rectangular parallelepiped shape is inserted through the insertion opening 13 at horizontal posture and is attached to the unit attaching portion 2*x* at approximately vertical posture.

Here, opening area Ar1 of the insertion opening 13 (see FIG. 14) is set smaller than installation area Ar2 of the unit attaching portion 2*x*. That is, the magnetic recording unit 24 having a rectangular parallelepiped shape is inserted in a direction from a portion having the smallest sectional area (at horizontal posture in the drawing) and attached to a predetermined position in the device housing. Here, the installation area denotes floor area occupied when a unit is installed.

Guide rails 15*a* which guide the magnetic recording unit 24 are arranged between the insertion opening 13 and the unit attaching portion 2*x*. The guide rails 15*a* are arranged at side faces opposed to the magnetic recording unit 24, respectively. Meanwhile, engaging portions 24*a* to be engaged with the guide rails 15*a* are arranged at lateral side faces of the magnetic recording unit 24, respectively. In the drawing, the engaging portions 24*a* are formed as protrusion walls. Here, it is also possible to adopt engaging rollers.

Figure 16:
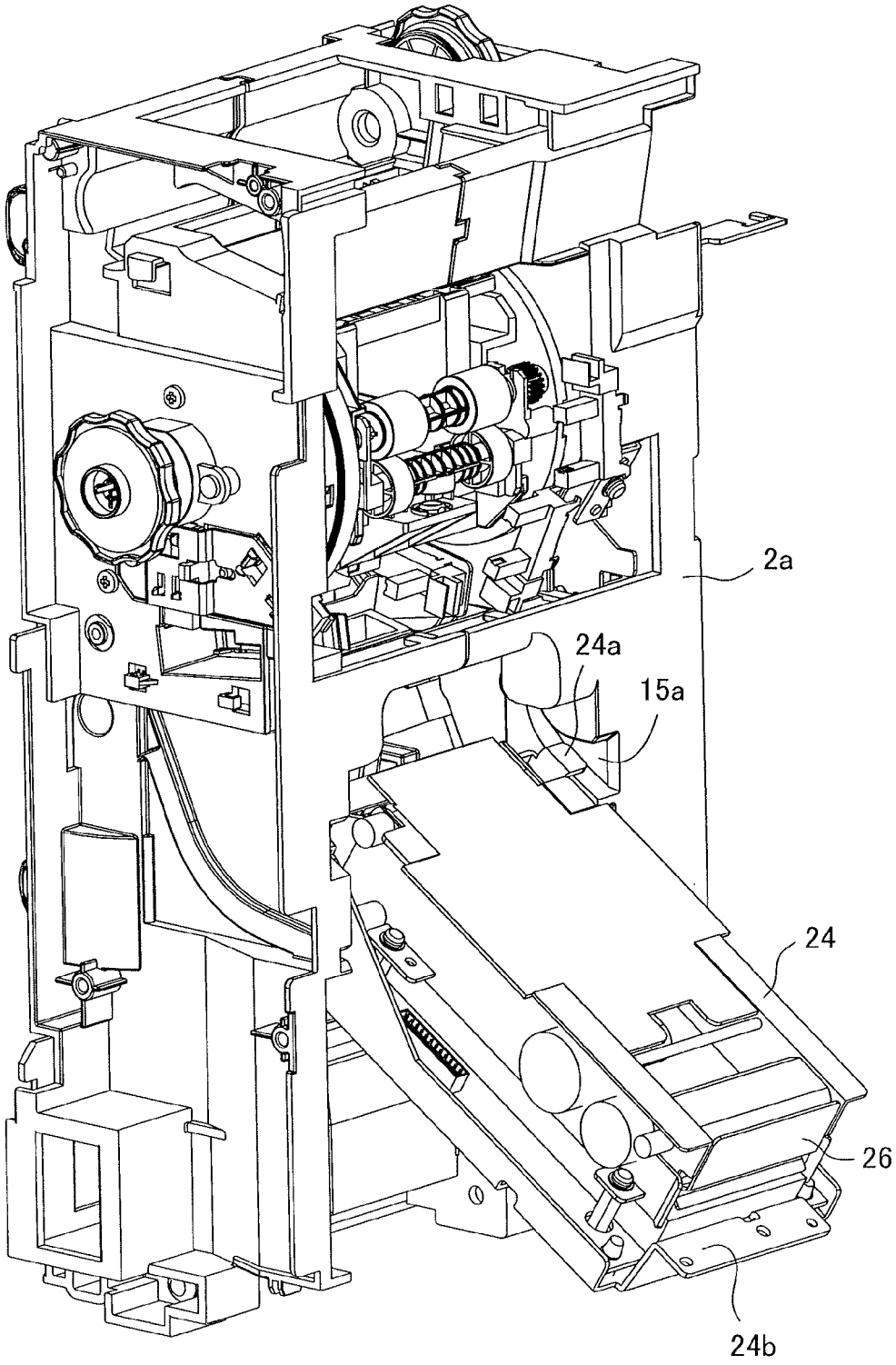
FIG. 16 is a view illustrating a state that the magnetic recording unit of the device in FIG. 1 is being inserted.
Figure 17:
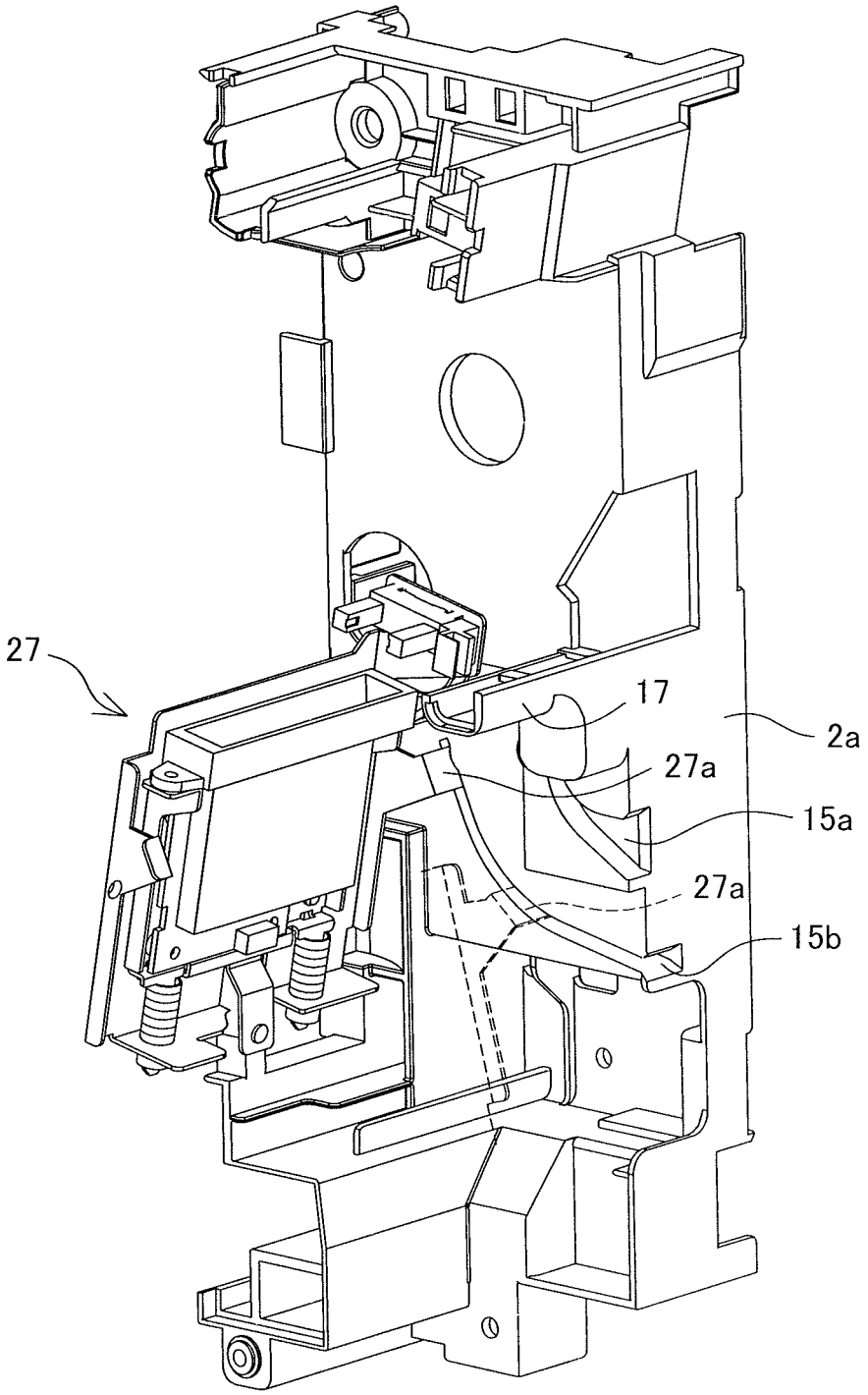
FIG. 17 is a view illustrating an attached state of an IC recording unit of the device in FIG. 1.

The guide rail 15*a* is provided with a bent portion 15*z* (see FIG. 18) which deflects posture of the magnetic recording unit 24 guided at horizontal posture to vertical posture. In the drawing, the bent portion 15*z* is formed into a curved shape. Here, the magnetic recording unit 24 having a rectangular parallelepiped shape is inserted through the insertion opening 13 at horizontal posture and the engaging portion (a projection or a roller) 24*a* of the magnetic recording unit 24 is engaged with the guide rail 15*a* (see FIG. 16). When the magnetic recording unit 24 is pushed into the device housing 2 along the guide rail 15*a*, the magnetic recording unit 24 is guided to the unit attaching portion 2*x* through the insertion opening 13 while posture thereof is concurrently deflected from horizontal posture to vertical posture.

Then, the magnetic recording unit 24 attached to the unit attaching portion 2*x* is fixed to the device frame. In the device illustrated in the drawing, a locking member 16 is arranged at the unit attaching portion 2*x* and an engaging projection 24*b* arranged at the magnetic recording unit 24 is engaged with the locking member 16. Here, it is also possible that the engaging projection 24*b* is fixed to the locking member 16 with a screw.

Figure 18:
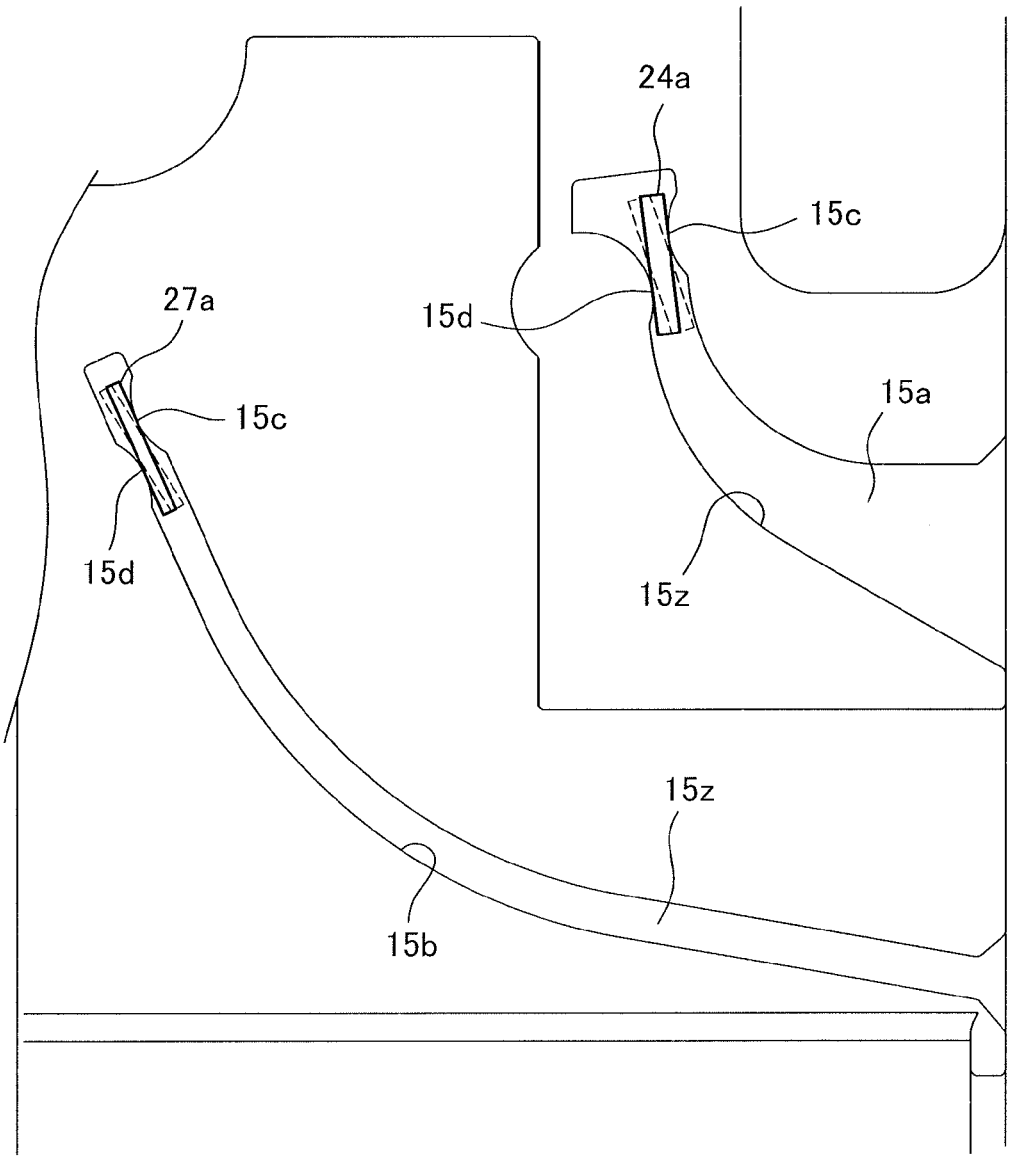
FIG. 18 is a view illustrating guide rails for attaching the magnetic recording unit and the IC recording unit.

Further, as illustrated in FIG. 18, support portions 15*c*, 15*d* which support the engaging portion 24*a* of the magnetic recording unit 24 are arranged at the device back side of the guide rail 15*a*. The engaging portion 24*a* is not abutted to the support portions 15*c*, 15*d* in a state that the magnetic recording unit 24 is on the way of being inserted. When the magnetic recording unit 24 is inserted to the attaching portion 2*x* and posture thereof is deflected to vertical posture, the engaging portion 24*a* is abutted to the support portions 15*c*, 15*d* to be supported by two points. In this manner, the magnetic recording unit 24 is positioned and engaged at a predetermined position of the attaching portion 2*x*.

[Structure of Magnetic Recording Unit]

Figure 13B:
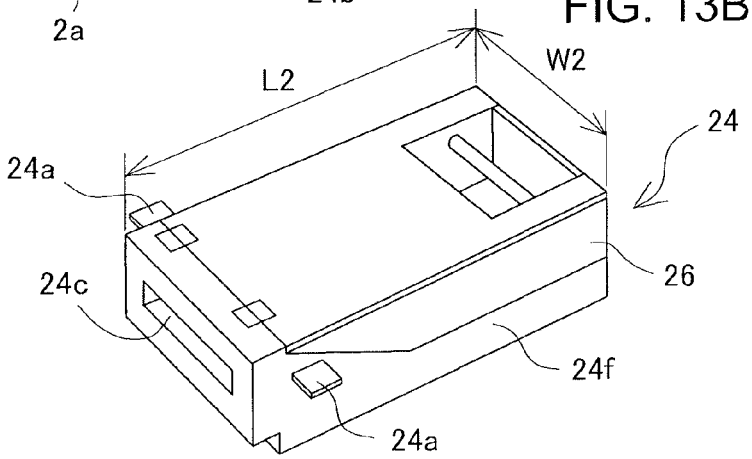

Next, a structure of the magnetic recording unit 24 will be described. As illustrated in FIG. 13B, a magnetic head and a card conveyance passage (not illustrated) are arranged in a unit frame 24*f*. A conveying roller is arranged in the card conveyance passage. A card conveyed to a passage entrance 24*c* is conveyed to the card conveyance passage by the conveying roller, and then, the magnetic head performs reading and writing on a magnetic stripe which is formed on the card.

A jam open-close cover 26 is hinge-connected to the unit frame 24*f* in an openable and closable manner. Accordingly, a card jammed in the passage is removed to the outside of the unit.

Figure 14:
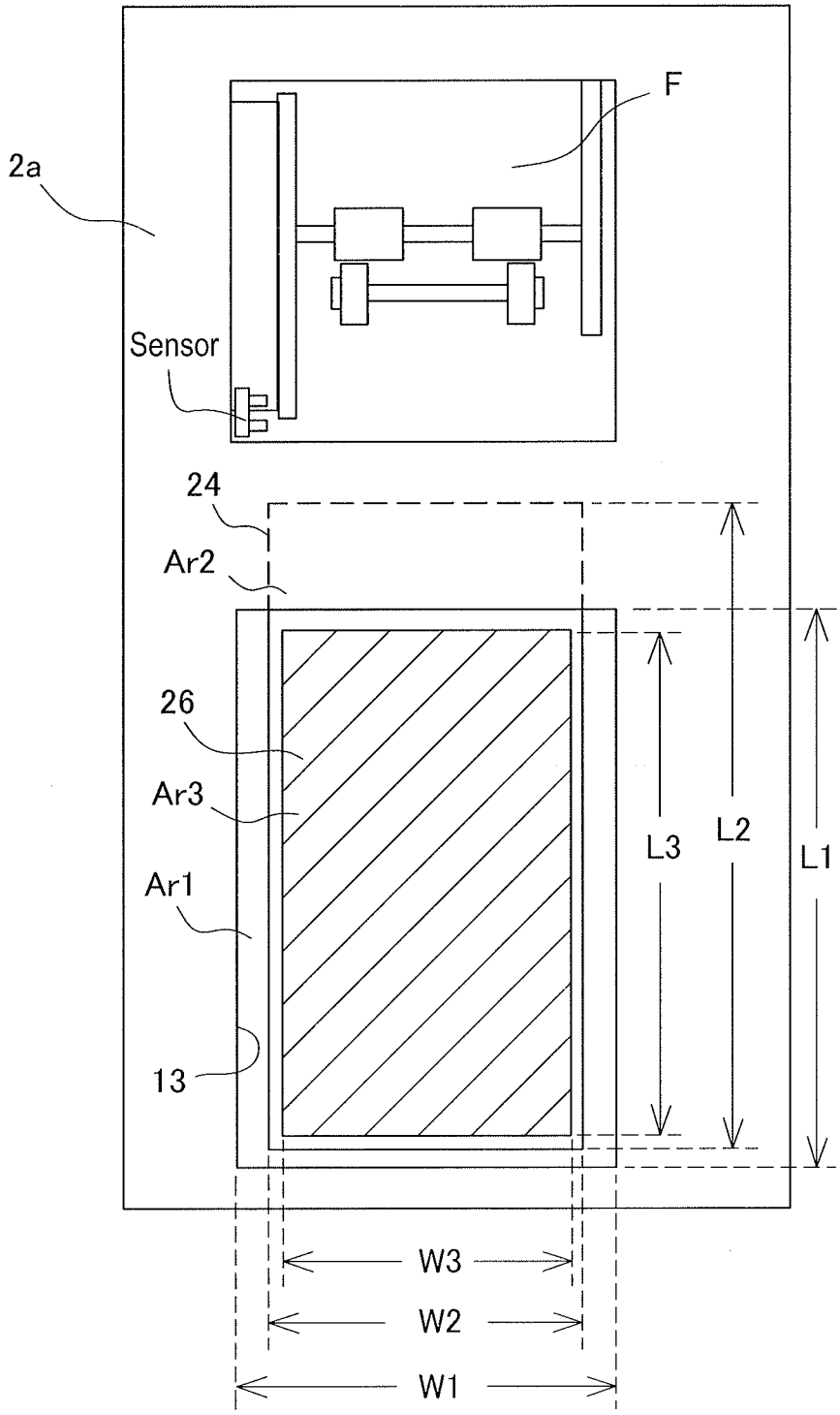
FIG. 14 is a conceptual view illustrating an attached state of the magnetic recording unit and the device housing.

FIG. 14 illustrates a relation among the insertion opening 13, the unit frame 24*f*, and the jam open-close cover 26. As is clear from the drawing, installation area Ar2 of the magnetic recording unit 24, opening area Ar1 of the insertion opening 13, and opening area Ar3 of jam processing opening satisfies a relation of "Ar2>Ar1>Ar3". Further, regarding heights in the longitudinal direction in the drawing, it is set to satisfy a relation of "a height L2 of the magnetic recording unit 24>a height L1 of the insertion opening 13>a height L3 of the jam open-close cover 26". Further, regarding lengths in the width direction, it is set to satisfy a relation of "a width W1 of the insertion opening 13>a width W2 of the magnetic recording unit 24 a width W3 of the jam open-close cover 26".

Figure 19:
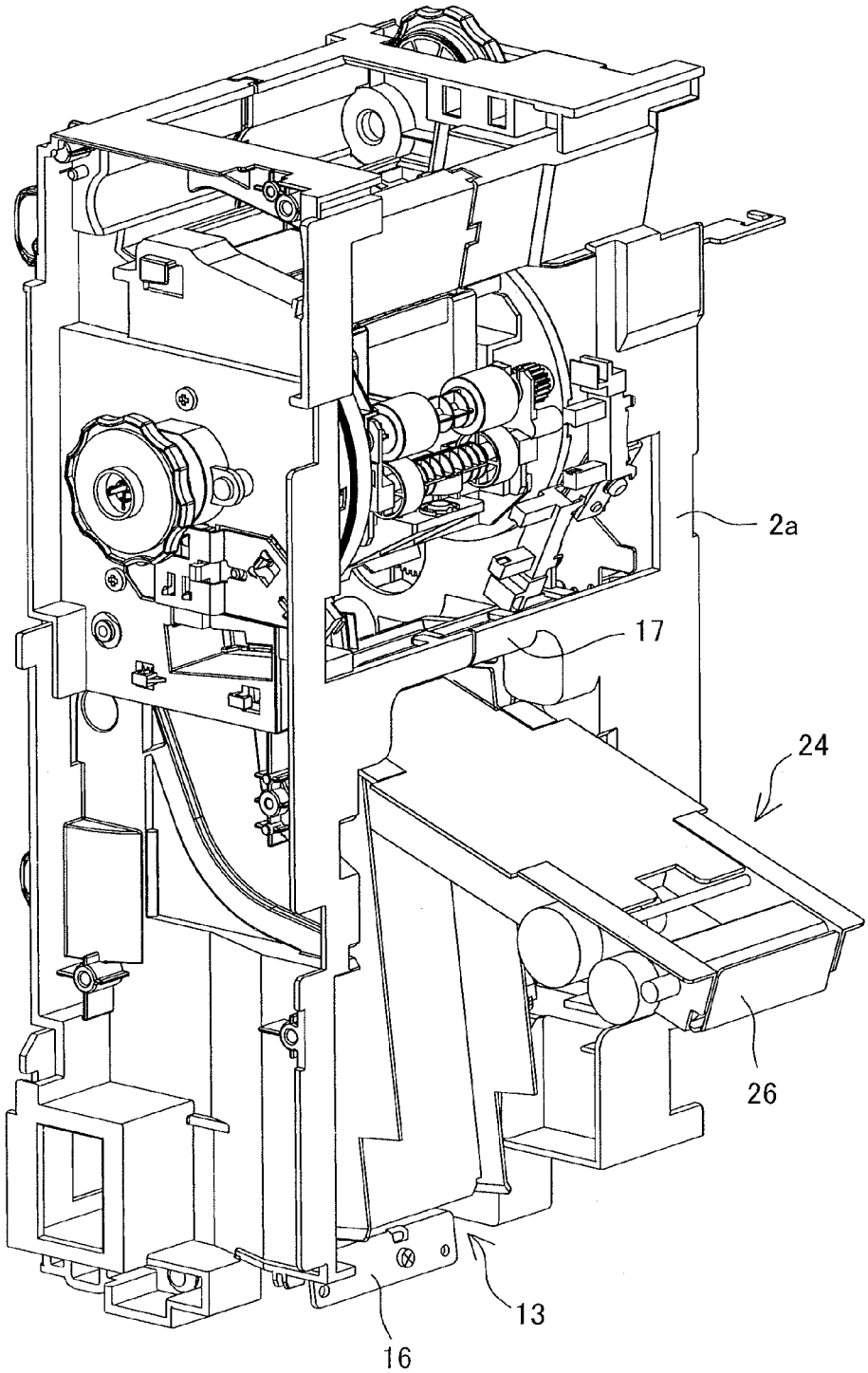
FIG. 19 is a view illustrating a state that a jam open-close cover is opened while the magnetic recording unit is in an attached state.

Accordingly, as illustrated in FIG. 19, it is possible that the magnetic recording unit 24 is attached to the unit attaching portion 2*x* as being inserted into the device housing 2 through the opening area Ar1 which is smaller than the installation area Ar2 and that the jam open-close cover 26 is opened and closed in a state that the open-close cover 14 is opened.

Here, since the height L2 of the magnetic recording unit 24 is larger than the height L1 of the insertion opening 13, the magnetic recording unit 24 in an attached state is overlapped with the device housing 2 at the turning unit F side in the height direction ("L2−L1" denotes an overlapped portion 17). According to the above, strength of the device housing 2 can be increased by reducing the insertion opening 13 in size. Further, since the overlapped portion 17 can be utilized as a harness guide through which wires for sensors and the like pass, it is possible to obtain an effect of downsizing the device (effective utilization of space).

In the present embodiment, the contact-type IC recording portion 27 (hereinafter, called the IC unit 27) is inserted to a unit attaching portion 2*y* using guide rails 15*b* through the insertion opening 13 as well. The guide rails 15*b* are formed into a curved shape similarly to the guide rails 15*a*. The guide rails 15*b* are configured to deflect posture of the IC unit 27 from horizontal posture to vertical posture while concurrently guiding the IC unit 27 to the unit attaching portion 2*y* through the insertion opening 13. Here, engaging portions 27*a* to be engaged with the guide rails 15*b* are arranged at the IC unit 27. When the IC unit 27 is pushed so that the engaging portions 27*a* follow the guide rails 15*b*, the IC unit 27 is guided to the unit attaching portion 2*y*. Methods of inserting and engaging (fixing) for the unit are the same as those for the magnetic recording unit 24.

According to the above, owing to arranging a plurality of the guide rails 15 approximately in parallel and inserting information recording units in sequence, a plurality of the information recording units can be contained in the device. In the present embodiment, the magnetic recording unit 24 is to be inserted after the IC unit 27 is inserted. For detaching, the IC unit 27 is to be detached after the magnetic recording unit 24 is detached.

[Control Configuration]

Figure 15:
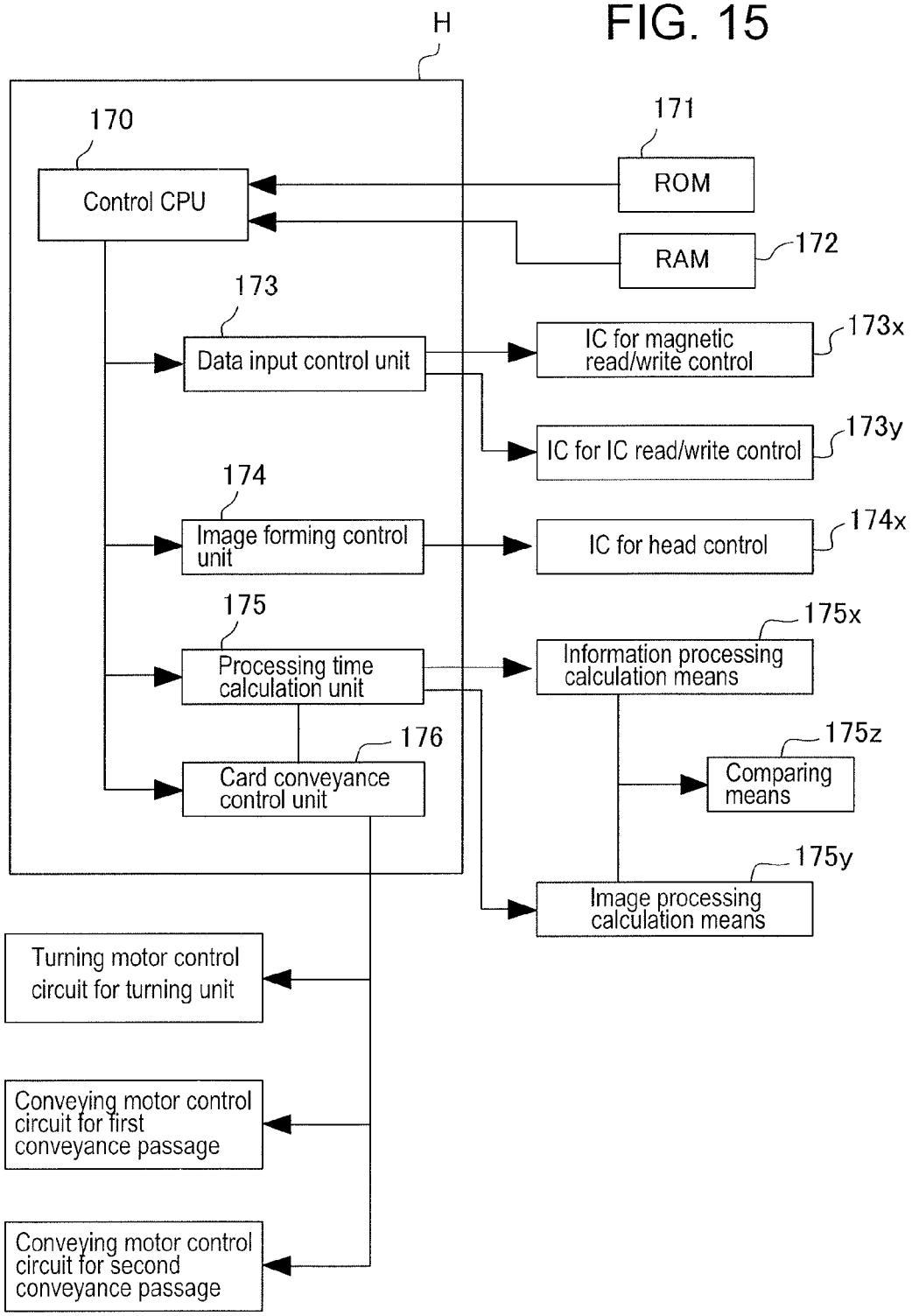
FIG. 15 is a view of a control structure of the device in FIG. 1.

Control configuration according to the present invention will be described with reference to FIG. 15. For example, a controller H is structured with a control CPU 170 and the control CPU 170 is provided with a ROM 171 and a RAM 172. Further, the control CPU 170 includes a data input control unit 173, an image forming control unit 174, a processing time calculation unit 175, and a card conveyance control unit 176. The card conveyance control unit 176 transmits a command signal to a drive circuit of a drive motor (not illustrated) to control card conveying means (first and second roller pairs 29, 30) arranged between the first medium conveyance passage P1 and the medium conveyance passage P1' at the downstream side thereof. The card conveyance control unit 176 transmits a command signal of a drive circuit of a swing motor of the turning unit F.

The card conveyance control unit 176 is electrically connected with respective sensors to receive state signals of sensors Set to Se 12, and further, is connected with the data input control unit 173 to receive a job signal.

The data input control unit 173 is configured to transmit a command signal for controlling transmitting and receiving of input data to a date read/write IC 173*x* which is incorporated in the magnetic recording portion 24 and to transmit a command signal similarly to a data read/write IC 173*y* of the IC recording portion. The image forming control unit 174 is configured to control image forming onto front and back faces of a card at the image forming section B.

The RAM 172 stores processing time for inputting data onto a card by the data input portion (magnetic and IC recording portions), for example, at a data table.

The card conveyance control unit 176 is provided with monitoring means and judging means, which are both incorporated in a control program of the control CPU 170. The monitoring means is configured to monitor a conveyance state of a card existing in the device while receiving state signals from the respective sensors and a job signal from the data input control unit 173.

The processing time calculation unit 175 is provided with information processing calculation means 175*x* which calculates finish timing of information recording on the second medium conveyance passage P2, image processing calculation means 175*y* which calculates finish timing of image forming at the image forming section D, and comparing means 175*z* which compares processing times calculated by the respective calculation means. The information processing calculation means 175*x* performs the above calculation from "time to set a card on the second medium conveyance passage for conveyance" and "time to record information on the card", for example, based on a feeding instruction signal. Here, the time to record information is calculated from previously-set scanning time of the magnetic head.

Further, the image processing calculation means 175*y* performs the above calculation, for example, from a length in the card moving direction of an image area on a card where an image is formed. Here, the processing time becomes the maximum when an image is to be formed on a leading side of a card in the conveying direction.

The control CPU 170 is configured to cause a recording medium conveyed from the turning unit F to be on standby at the standby section E when the finish timing of the image forming is determined to be later than the finish timing of the information recording by the comparing means 175*z*. Further, the control CPU 170 is configured to convey a recording medium conveyed from the turning unit F without being on standby at the standby section E when the finish timing of the information recording is determined to be later than the finish timing of the image forming by the comparing means 175*z*.

In the present embodiment, a unit insertion opening being smaller than installation area of an information recording unit is formed at a housing and the information recording unit is guided to an information recording section while posture of an information recording unit inserted through the insertion opening is changed by a guide rail so that insertion posture for being inserted through the insertion opening and attached posture attached to the information recording section are different. According to the above, following effects are obtained.

For attaching the recording unit into the housing in a detachably attachable manner, the recording unit is attached to and detached from the housing through the unit insertion opening being smaller than the installation area of the recording unit. Therefore, the housing can be formed relatively rigid, small, and compact. That is, it is possible to prevent strength decrease of the housing and upsizing of inner space of the housing which are to be caused that the housing ensures an opening of the housing matched to an external shape of the recording unit and space (space for attaching and detaching) for insertion of the unit attaching portion.

In the present embodiment, for example, when an information recording unit has an external shape being a rectangular parallelepiped, it is possible to form a unit insertion opening at a housing to be approximately matched with the minimum sectional area. Accordingly, the housing becomes relatively rigid, so that a device frame can be simplified to have a monocoque structure or the like. In addition, in a case that the device has a structure that a plurality of recording units, a cartridge cassette, an ink cartridge, and the like are attached to and detached from the housing, the housing can be downsized with a simple structure.

INDUSTRIAL APPLICABILITY

The present invention relates to an information recording device which records electronic information and image information on a recording medium such as a plastic card and a thick-paper card, and relates to improvement of a jam processing mechanism which eliminates a card jammed in the device. Accordingly, the present invention has industrial applicability.

EXPLANATION OF REFERENCES

2: Device housing

3: Card cassette

20, 21: Roller pair
23: Non-contact type IC recording portion (Electronic information recording means)
36: De-curl mechanism
65: Medium introduction passage
66: Passage open-close member
68: Medium conveyance path
70: Shielding plate
74: Pressing portion
80: Rotary frame
86: Unit frame
100: Cassette mount area
A: Information recording section
B: Image transferring section
C: Medium storing section
D: Image forming section
F: Turning unit
P1, P1': Medium conveyance passage

The invention claimed is:

1. An information recording device for recording electronic information and image information on a recording medium, comprising:

a housing;

a medium storing section housed in the housing for storing the recording medium, and including a pickup portion for feeding the recording medium stored therein;

a medium introduction passage for conveying the recording medium from the medium storing section in a supplying direction of the recording medium through the pickup portion;

an image forming section disposed below and overlapping the medium storing section in an extending direction of the medium introduction passage, for forming the image information on the recording medium;

a medium conveyance passage for conveying the recording medium conveyed from the medium introduction passage to the image forming section;

a passage open-close member arranged above the medium conveyance passage, and between the medium storing section and the image forming section, and overlapping the image forming section in the extending direction of the medium introduction passage for removing the recording medium jammed at the image forming section; and an information recording section communicating with the medium introduction passage and the medium conveyance passage, and disposed below the medium storing section for recording the electronic information on the recording medium, the information recording section including electronic information recording means which is incorporated in the passage open-close member, and a medium conveyance path for conveying the recording medium from the medium conveyance passage toward the electronic information recording means.

2. The information recording device according to claim 1, wherein the electronic information recording means is non-contact type recording means for recording information on the recording medium in a non-contact state.

3. The information recording device according to claim 2, further comprising:

a shielding plate for shielding a radio wave signal of the non-contact type recording means, arranged between the medium conveyance path and the medium conveyance passage, wherein the shielding plate shields the recording medium on the medium conveyance passage from the radio wave signal transmitted from the non-contact type recording means.

4. The information recording device according to claim 1, wherein the medium storing section includes a cassette mount area to which a cassette storing the recording medium is attachable, and the passage open-close member is configured to form a bottom face wall of the cassette mount area in a closed state and to provide accessibility to the medium conveyance passage from the cassette mount area in an opened state.

5. The information recording device according to claim 1, wherein the medium conveyance passage is provided with a turning unit for switching a conveying direction of the recording medium at least between two directions including first and second directions, and the turning unit switches between the first direction in which the recording medium is to be conveyed to the information recording section and the second direction in which the recording medium is conveyed to the medium conveyance passage.

6. The information recording device according to claim 5, wherein the turning unit includes a rotary frame which is supported axially and swingably by a device frame, at least one roller pair which is arranged at the rotary frame for holding the recording medium, unit drive means which swings the rotary frame, and roller drive means which rotates the roller pair forwardly and reversely, and the recording medium is configured to be introduced to and conveyed from the medium conveyance path with rotation of the roller pair in forward and reverse directions.

7. The information recording device according to claim 1, further comprising: a de-curl mechanism arranged on the medium conveyance passage at a downstream side from the image forming section, and including a pressing portion for correcting a curl of an image-formed recording medium, and a unit frame which holds the pressing portion, wherein the passage open-close member is configured to provide accessibility to the de-curl mechanism from the outside of the housing in an opened state.

8. The information recording device according to claim 7, wherein the unit frame of the de-curl mechanism is supported axially and rotatably by a device frame so that the pressing portion is movable from the inside of the medium conveyance passage to the outside thereof when the passage open-close member is in the opened state.

9. The information recording device according to claim 1, wherein the medium storing section is arranged to store the recording medium to laterally overlap with each other to feed the recording medium vertically toward the medium introduction passage.

10. The information recording device according to claim 9, further comprising a turning unit disposed below the medium storing section and communicating with the medium storing section through the medium introduction passage, for switching a conveying direction of the recording medium from the medium storing section between a first direction in which the recording medium is conveyed to the information recording section and a second direction in which the recording medium is conveyed to the medium conveyance passage.

11. The information recording device according to claim 10, wherein the pickup portion supplies the recording medium stored in the medium storing section toward the turning unit in a vertical direction through the medium introduction passage, and the turning unit conveys the recording medium toward the image forming section through the medium conveyance passage in a direction horizontal to the medium storing section and intersecting the medium introduction passage.

12. The information recording device according to claim 1, wherein the passage open-close member includes a lid forming a bottom surface of the medium storage section to provide access to the medium conveyance passage from the medium storage section so that the bottom face wall of the passage open-close is capable of opening to remove the recording medium jammed at the image forming section.

13. An information recording device which records electronic information and image information on a recording medium, comprising:

a housing;

a medium storing section which stores a recording medium;

an information recording section which records electronic information on the recording medium;

an image forming section which forms image information on the recording medium;

a medium introduction passage which introduces the recording medium from the medium storing section toward the information recording section;

a medium conveyance passage which conveys the recording medium conveyed from the medium introduction passage to the image forming section;

a passage open-close member which is arranged at the medium conveyance passage for removing the recording medium jammed at the image forming section, and a shielding plate, wherein the medium storing section, the passage open-close member, and the image forming section are arranged in the housing in this order, the information recording section includes electronic information recording means which is incorporated in the passage open-close member, and a medium conveyance path which conveys a recording medium from the medium conveyance passage toward the electronic information recording means, the electronic information recording means is non-contact recording means which records information on the recording medium in a non-contact state, the shielding plate shields a radio wave signal of the non-contact recording means and is arranged between the medium conveyance path and the medium conveyance passage so that the shielding plate shields the recording medium on the medium conveyance passage from the radio wave signal transmitted from the non-contact recording means, the medium storing section includes a cassette mount area to which a cassette storing the recording medium is attachable, and the passage open-close member is configured to form a bottom face wall of the cassette mount area in a closed state and to provide accessibility to the medium conveyance passage from the cassette mount area in an opened state.

* * * * *